US009468277B2

(12) United States Patent
King

(10) Patent No.: US 9,468,277 B2
(45) Date of Patent: Oct. 18, 2016

(54) RETRACTABLE SPINNER WHEELS FOR A LUGGAGE CASE

(71) Applicant: Samsonite IP Holdings S.a r.l., Luxembourg (LU)

(72) Inventor: William L. King, Swansea, MA (US)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 26 days.

(21) Appl. No.: 14/188,893

(22) Filed: Feb. 25, 2014

(65) Prior Publication Data

US 2014/0238803 A1 Aug. 28, 2014

Related U.S. Application Data

(60) Provisional application No. 61/769,143, filed on Feb. 25, 2013.

(51) Int. Cl.
*A45C 5/14* (2006.01)
*A45C 13/26* (2006.01)

(52) U.S. Cl.
CPC ..... *A45C 5/146* (2013.01); *A45C 2013/267* (2013.01)

(58) Field of Classification Search
CPC ..... A45C 5/146; A45C 2013/267
USPC ..... 190/18 A
See application file for complete search history.

(56) References Cited

U.S. PATENT DOCUMENTS 1,118,931 A 12/1914 Hasley
1,176,876 A * 3/1916 Vartabedian ..... A45C 5/143 190/18 A
2,917,317 A * 12/1959 Denholm ..... A45C 5/146 190/18 A
4,254,850 A * 3/1981 Knowles ..... A45C 5/146 16/113.1
4,588,055 A * 5/1986 Chen ..... A45C 5/146 190/115

(Continued)

FOREIGN PATENT DOCUMENTS

CN 2596820 Y 1/2004
CN 2611195 Y 4/2004

(Continued)

OTHER PUBLICATIONS

Brochure: Inno-Tech Corp., "Inspired by nature", 2 pages, at least as early as Feb. 27, 2013.

*Primary Examiner* — Sue A Weaver
(74) *Attorney, Agent, or Firm* — Dorsey & Whitney LLP

(57) ABSTRACT

A luggage case may include front, back, side, top, and bottom walls. At least one recess may be defined by at least one of the walls near the luggage case's bottom end. Two or more spinner wheel assemblies may be joined to at least one of the walls proximate the luggage case's bottom end. Each spinner wheel assembly may be configured to pivot its at least one wheel from a first position where the at least one wheel engages a support surface to allow the luggage case to be wheeled on the support surface to a second position where the least one wheel is positioned within one of the at least one recess and does not project beyond the bottom wall. An actuation mechanism that includes a user engagement component and at least one actuation assembly may be used to move the wheels between their first and second positions.

22 Claims, 15 Drawing Sheets

(56) References Cited

U.S. PATENT DOCUMENTS

| | | | | |
|---|---|---|---|---|
| 4,773,123 | A | 9/1988 | Yu | |
| 5,097,922 | A | 3/1992 | Stagi | |
| 5,758,752 | A | 6/1998 | King et al. | |
| 6,182,981 | B1 * | 2/2001 | Kuo | A45C 5/14 190/18 A |
| 6,454,064 | B1 * | 9/2002 | Cheng | A45C 9/00 190/11 |
| 6,454,065 | B1 * | 9/2002 | Chen | A45C 5/14 16/18 B |
| 6,612,411 | B2 | 9/2003 | Nykoluk et al. | |
| 7,066,311 | B2 | 6/2006 | O'Shea | |
| 7,503,439 | B2 | 3/2009 | O'Shea et al. | |
| 7,748,508 | B2 | 7/2010 | Lee | |
| 7,861,834 | B2 | 1/2011 | Gorga et al. | |
| 7,954,610 | B2 | 6/2011 | Dayton et al. | |
| 7,997,591 | B2 | 8/2011 | Arthur | |
| 8,020,678 | B2 * | 9/2011 | Tsai | A45C 5/146 190/115 |
| 8,342,562 | B2 | 1/2013 | Chaudeurge | |
| 2001/0035320 | A1 * | 11/2001 | Tiramani | A45C 3/001 190/115 |
| 2004/0000457 | A1 * | 1/2004 | Sanford-Schwentke | A45C 13/262 190/18 A |
| 2005/0023096 | A1 * | 2/2005 | Tiramani | A45C 5/146 190/18 A |
| 2010/0000805 | A1 * | 1/2010 | Pan | A45C 5/14 180/19.1 |
| 2010/0025174 | A1 * | 2/2010 | Dayton | A45C 13/262 190/18 A |
| 2012/0261223 | A1 * | 10/2012 | Pattni | A45C 5/14 190/18 A |
| 2012/0267208 | A1 | 10/2012 | D'Angelo | |
| 2013/0186723 | A1 | 7/2013 | D'Angelo | |
| 2013/0313795 | A1 * | 11/2013 | Arthur | A45C 5/146 280/43.17 |

FOREIGN PATENT DOCUMENTS

| | | | | |
|---|---|---|---|---|
| CN | 2933105 | Y | 8/2007 | |
| FR | 1145985 | A * | 11/1957 | A45C 5/146 |
| WO | 2012148492 | A1 | 11/2012 | |

* cited by examiner

FIG. 14B
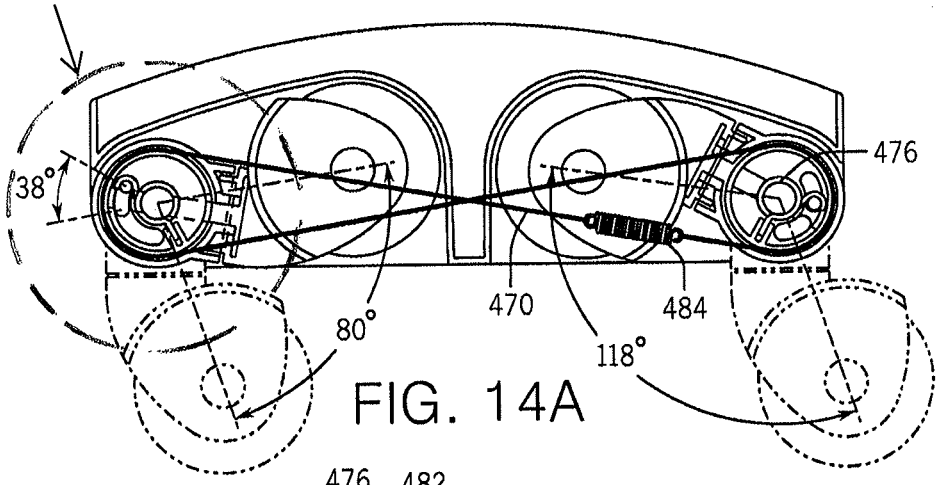
FIG. 14A
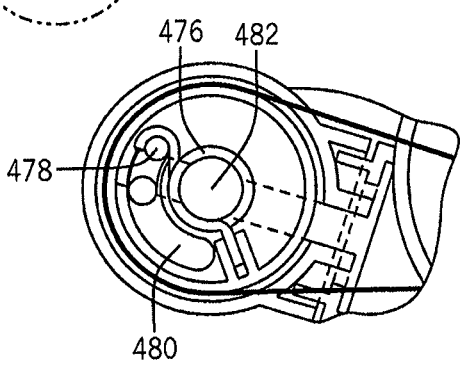
FIG. 14B

RETRACTABLE SPINNER WHEELS FOR A LUGGAGE CASE

CROSS-REFERENCE TO RELATED APPLICATIONS

This application claims the benefit, under 35 U.S.C. §119(e), of U.S. provisional application No. 61/769,143, entitled "Retractable Spinner Wheels for a Luggage Case" and filed on Feb. 25, 2013, the entire contents of which are hereby incorporated herein by reference.

TECHNICAL FIELD

The present invention relates to a luggage articles, and in particular to wheeled luggage cases and more specifically to the wheel arrangements for such wheeled luggage cases.

BACKGROUND

Luggage items and in particular luggage cases (suitcases) conventionally include wheels and tow handle arrangements to allow them to be wheeled and more easily moved by a user. Originally, fixed axis wheels were provided at one end on the sides of a case to allow the case to be wheeled in a length wise manner (long side of the case generally horizontal). This arrangement with a pair of wheels has evolved to provide wheels that are mounted to also rotate about a vertical axis (so called spinner wheels). More recently, there has been a change to provide cases that are arranged to be wheeled in a more vertical orientation (i.e. with their longest sides/dimension) vertical, and an increasing trend to provide four spinner type wheels on the bottom end. Such multiple spinner wheels allow better maneuverability of the case and easier user handling.

A problem with wheeled cases is that in order to minimize the overall dimensions of the case, it is desirable to minimize the size of the wheels. Small wheels, however, are less able to cope with and operate on rough surfaces. Spinner wheels, in particular, take up a lot of space with the actual diameter of the wheel having to be reduced to minimize overall space.

It is therefore desirable to provide an improved luggage article, and more specifically an improved wheel arrangement on a luggage case that addresses the above described problems and/or which more generally offers improvements or an alternative to existing arrangements.

SUMMARY

According to the present invention there is therefore provided a luggage case as described in the accompanying claims.

In an embodiment of the invention, a luggage case may include opposing front and back walls, opposing side walls, opposing top and bottom end walls, at least one recess, two or more spinner wheel assemblies, and an actuation mechanism. The opposing front and back walls may form major faces of the luggage case. The opposing side walls may form side faces of the luggage case and may extend between the opposing front and back walls. The opposing top and bottom end walls may form top and bottom ends of the luggage case. The front, back, side, top end, and bottom end walls may together define an outer structure and enclosed space of the luggage case. The at least one recess may be defined by at least one of the walls proximate the bottom end of the luggage case. The two or more of spinner wheel assemblies may be joined to at least one of the walls proximate the bottom end of the luggage case. Each spinner wheel assembly may include at least one wheel that rotates about at least two orthogonal axes. Each spinner wheel assembly may be configured to pivot the at least one wheel of the spinner wheel assembly about a pivot axis from a first position where the at least one wheel projects beyond the bottom end wall in order to engage a support surface to allow the luggage case to be wheeled on the support surface to a second position where the least one wheel is positioned within one of the at least one recess and does not project beyond the bottom end wall. The actuation mechanism may include a user engagement component and at least one actuation assembly. The user engagement component may be movably joined to one of the walls of the luggage case at a location remote from the two or more spinner wheel assemblies. The at least one actuation assembly may be operatively associated with the user engagement component and operatively associated with at least one of the two or more spinner wheel assemblies. Selective movement of the user engagement component may pivot the at least one wheel of each spinner wheel assembly operatively associated with the at least one actuation assembly between the first and second positions.

Such a luggage case can have its wheels deployed to an operational position to wheel the luggage case on a support surface while also allowing its wheels to be moved to a retracted position to reduce the overall size of the luggage case, which may be especially useful when the luggage case is stored within a confined space, such as an aircraft overhead compartment.

Preferably, the first position is an operational position of the at least one wheel and the second position is a storage position of the at least one wheel.

In some embodiments of the luggage case, the user engagement component may rotate between a first position that corresponds to the storage position of the at least one wheel and a second position that corresponds to the operational position of the at least one wheel.

The actuation mechanism may be configured to allow the user engagement component to rotate from the first position of the user engagement member to the second position of the user engagement component even if the at least one wheel of any of the two or more spinner wheel assemblies does not pivot from the storage position to the operational position. Such a luggage case allows the user to rotate the user engagement component from the first position to the second position without placing undue stresses on the components of the actuation mechanism when one or more wheels of the spinner wheel assemblies fail to deploy to their operational position from their storage position. Each of the at least one actuation assembly may include a first cable having a connector with a slot. The luggage case may include a telescoping tow handle housing that is located near the user engagement component and that includes a curved slot. An elongated member, preferably a pin, a fastener, or the like, may be joined to the user engagement component and may extend through the slot and the curved slot.

The actuation mechanism may be configured to allow the user engagement component to rotate from the second position of the user engagement member to the first position of the user engagement component even if the at least one wheel of any of the two or more spinner wheel assemblies is prevented from moving from the operational position to the storage position by an obstruction, such as one of the walls of the luggage case. Such a luggage case allows the user to rotate the user engagement component from the second position to the first position of the user engagement component without placing undue stresses on the components of the actuation mechanism when one or more wheels of the spinner wheel assemblies are prevented from returning to their storage position from their operational position. Each of the at least one actuation assembly may include a bias member, preferably a spring, operatively associated with the user engagement component and operatively associated with the at least one wheel of at least one of the two or more spinner wheel assemblies. The spring elongates when the at least one wheel operatively associated with the spring is prevented from moving from the operational position to the storage position.

The at least one actuation assembly may include a second bias member, such as a spinner wheel spring, operatively associated with the at least one wheel of one of two or more spinner wheel assemblies. The spinner wheel spring may bias the at least one wheel associated with the spinner wheel spring to either the operational position or the storage position.

In some embodiments of the luggage case, a lock assembly may be operatively associated with the at least one wheel of one of the two or more spinner wheel assemblies and may be configured to lock the at least one wheel associated with the lock assembly in the operational position. The at least one actuation assembly may include a pulley with a cam surface and a disc with a slot that are operatively associated with the at least one wheel associated with the lock assembly and that are operatively associated with the lock assembly. The disc may be joined to the pulley in such a manner that the pulley rotates relative to the disc within a predefined rotational range and also rotates in conjunction with the disc for another predefined rotational range. The lock assembly may include a lock housing, a bias member, and an engagement member biased by the bias member to project from the lock housing and configured to slide relative to the lock housing. At least an end portion of the engagement member may be received within the slot of the disc when the at least one wheel associated with the lock assembly is positioned in the operational position. Rotation of the pulley relative to the disc may remove the engagement member from slot in the disc via engagement of the engagement member with the cam surface of the pulley.

In some embodiments of the luggage case, the user engagement component may be a dial or a lever. Preferably the user engagement component may include a detent configured to resist movement of the user engagement position at positions of the user engagement component corresponding to the first and second positions of the at least one wheel of said two or more spinner wheel assemblies.

In some embodiments of the luggage case, the user engagement component may take the form of a telescoping tow handle that includes at least one rack. The at least one rack may engage at least one gear operatively associated with the at least one actuation assembly. Extending the tow handle may pivot the at least one wheel to the first position, and retracting the tow handle may pivot the at least one wheel to the second position.

In some embodiments of the luggage case, some or all of the two or more spinner wheel assemblies may be configured to rotate their respective at least one wheel to a desired orientation relative to the walls of the luggage case.

Each of the at least one recess may include at least one open side, and preferably may include at least two open sides. Each of the least one recess may include an elongated rib projecting from an upper surface defining the recess. The elongated rib may be received between a gap of the at least one wheel of at least one of said two or more spinner wheel assemblies when said at least one wheel is positioned in the second position.

In some embodiments of the luggage case, there may be four spinner wheel assemblies with each spinner wheel assembly positioned proximate a corner of the luggage case.

In some embodiments of the luggage case, there may be two actuation assemblies with each actuation assembly joined to two of the spinner wheel assemblies.

The luggage case preferably includes an opening line formed in said side faces and end walls along which separates said luggage case into a lid and base to allow access to the enclosed space within the luggage case.

The user engagement component may be movably joined preferably to the back wall of the luggage case.

The luggage case is preferably a hardside luggage case wherein the front, back and side walls and top and bottom ends are all rigid and self-supporting.

BRIEF DESCRIPTION OF THE DRAWINGS

The present invention will now be described by way of example only with reference to the following figures in which:

FIG. 14A shows a schematic elevation illustration of a mechanism for operatively joining a spinner wheel assembly to a respective pulley of the actuation mechanism shown in FIGS. 13A-13D; FIG. 14B is a close-up illustration of the mechanism shown in FIG. 14A for operably joining a spinner wheel assembly to a respectively pulley of the actuation mechanism.

DETAILED DESCRIPTION

Figure 1:
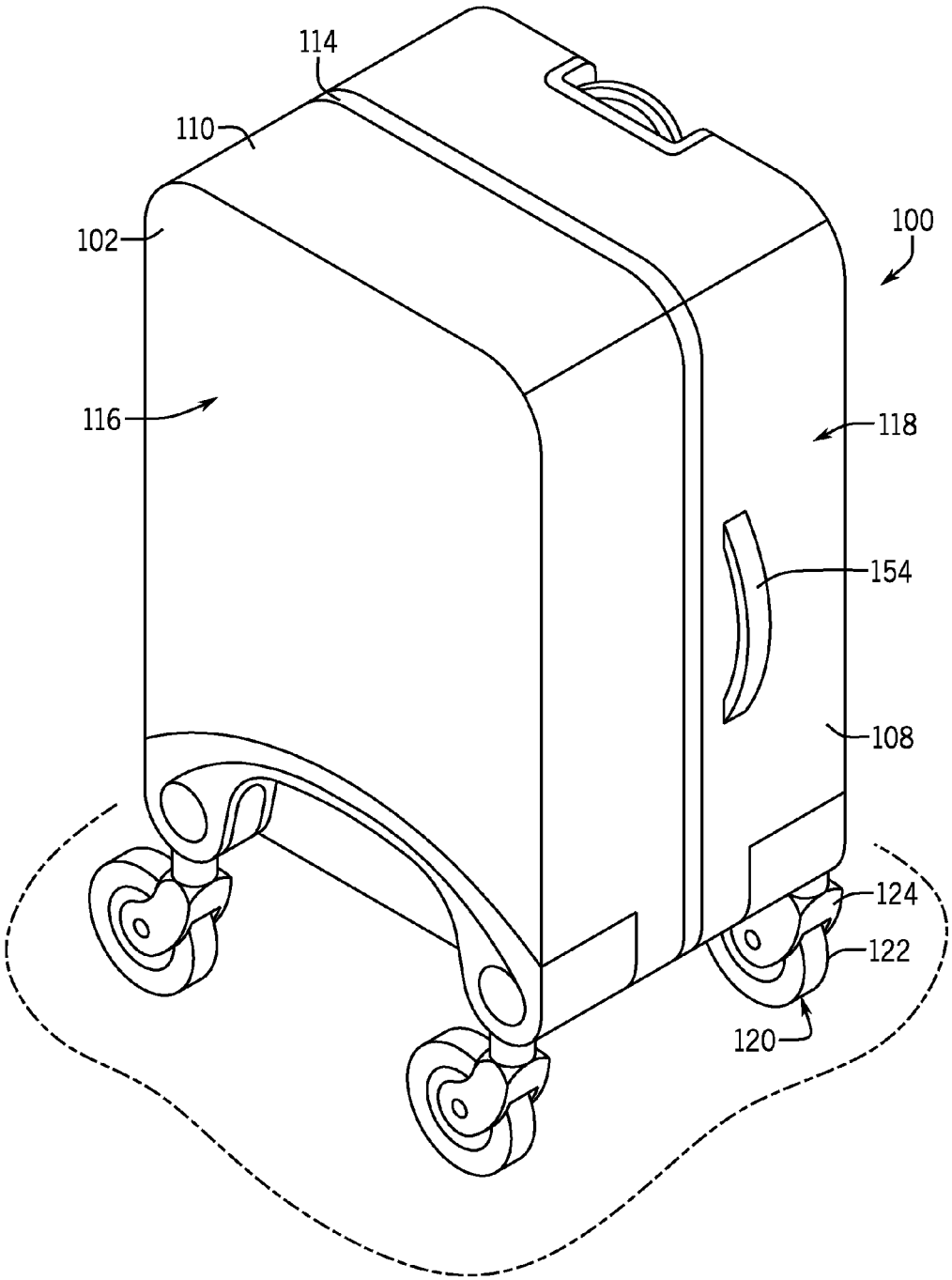
FIG. 1 is a schematic front perspective view of a luggage case according to an embodiment of the invention.
Figure 2:
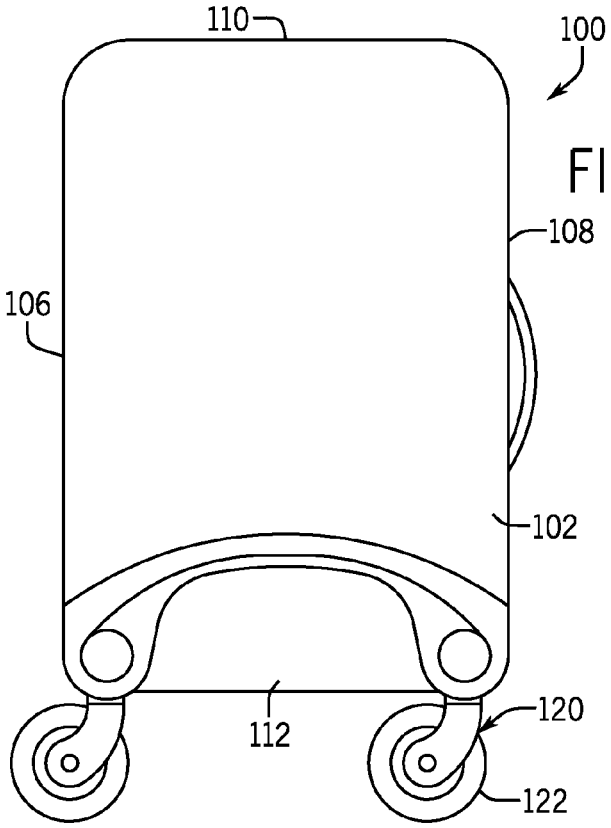
FIG. 2 is a schematic front elevation view of the luggage case shown in FIG. 1.
Figure 3:
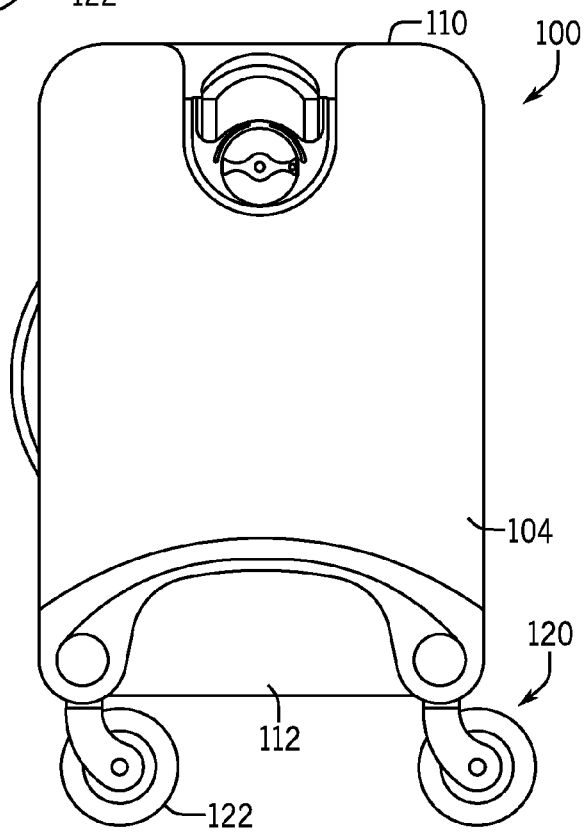
FIG. 3 is a schematic back elevation view of the luggage case shown in FIG. 1.

Referring to FIGS. 1-3, a wheeled luggage case 100 according to an embodiment of the invention includes a generally cuboid structure formed from multiple walls 102, 104, 106, 108, 110, 112 defining an enclosed internal volume of the luggage case 100 in which to contain a user's belongings. The luggage case 100 may include opposing front and back walls 102, 104 forming major front and back faces of the luggage case 100, opposing side walls 106, 108 forming side faces of the luggage case 100, and opposing top and bottom end walls of the luggage case 100. Collectively, the walls 102, 104, 106, 108, 110, 112 define a housing or an outer structure of the luggage case 100 that, in turn, defines an enclosed internal volume.

The luggage case 100 is of a type generally known as a hard side case in which the outer structure and walls of the luggage case 100 are relatively rigid. The outer structure of the luggage case 100 may be, for example, plastic (e.g., composite plastic, acrylonitrile butadiene styrene, polymer, thermoplastic, and so forth) and may be manufactured by extrusion, mold forming, blow molding, and so forth.

The luggage case 100 may be split along a generally vertical plane with an opening line 114 parallel to the major faces. The luggage case 100 may include a lid 116, which includes the front wall 102, and a base 118, which includes the back wall 104. In this embodiment, the opening line 114 may be located approximately halfway between the front face and the back face such that the base 118 includes the back wall 104 and approximately one-half of the side, top, and bottom end walls 106, 108, 110, 112, and the lid 116 includes the front wall 102 and approximately one-half of the side, top, and bottom end walls 106, 108, 110, 112. In other embodiments, the opening line 114 may be much closer to the front face such that the lid 116 includes primarily the front wall 102, and the base includes the back wall 104 and the majority of the side, top, and bottom end walls 106, 108, 110, 112.

The lid 116 may be connected to the base 118 along a side via a hinge in a conventional manner, and the luggage case 100 may be opened at the opening line 114 to access the internal volume. The hinge may be formed of a zipper and a fabric strip, a piano hinge, discrete hinges spaced apart, or an articulating joint. The piano hinge, the discrete hinges, or the articulating joint may be made from metal, plastic, any other suitable material, or any combination thereof. The hinge may be stitched to the lid 116 and also to the base 118, or may be coupled in another suitable manner. In some examples, the luggage case 100 may be hinged along the left or the right side wall 106, 108, whereas in other examples, the luggage case 100 may be hinged along the bottom end wall 112, or along any other wall of the luggage case 100. A zipper along a periphery of the opening line or other conventional closure arrangement, for example clamp locks, secures the lid 116 to the base 118 to close the luggage case 100.

Spinner wheel assemblies 120 may be mounted to at least one of the walls 102, 104, 106, 108, 110, 112, often the bottom end wall 112, near the bottom end of the luggage case 100. Each spinner wheel assembly 120 may be positioned proximate a corner of the luggage case 100. Each spinner wheel assembly 120 may include one or more spinner wheels 122 rotationally mounted to a spinner fork bracket 124 to rotate about a wheel axis. The wheel axis may be generally horizontal and parallel to the bottom end wall 112 of the luggage case 100, and the spinner fork bracket 124 may be rotationally mounted to the bottom end wall 112 of the luggage case 100 to rotate about a generally vertical spinner axis that is perpendicular to the bottom end wall 112 of the luggage case 100. Such an arrangement allows the spinner wheels 122 to rotate about two orthogonal axes: the horizontal wheel axis and the vertical spinner axis.

Figure 4A:
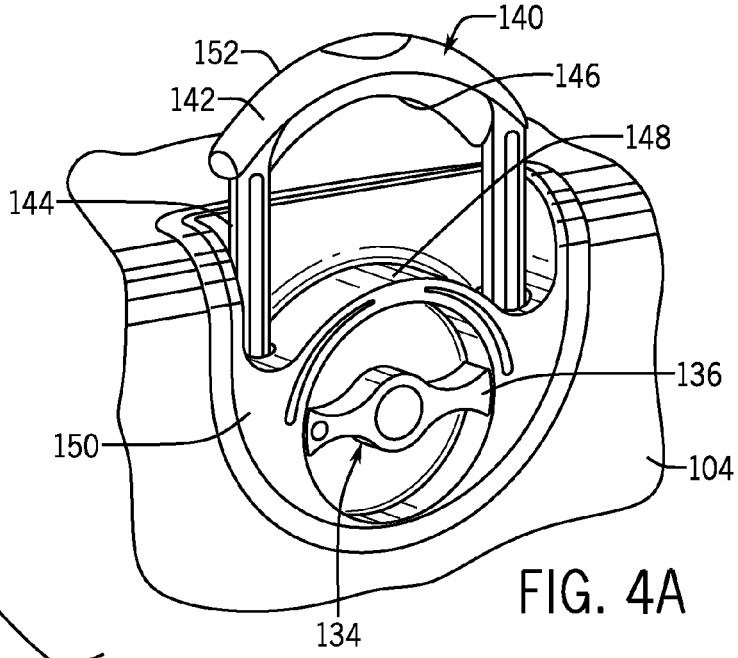
FIGS. 4A, 4B, and 4C are schematic illustrations showing an upper back portion of the luggage case shown in FIG. 1 and lower portions of the luggage case with the lower portions showing the wheels in retracted and deployed positions.
Figure 4B:
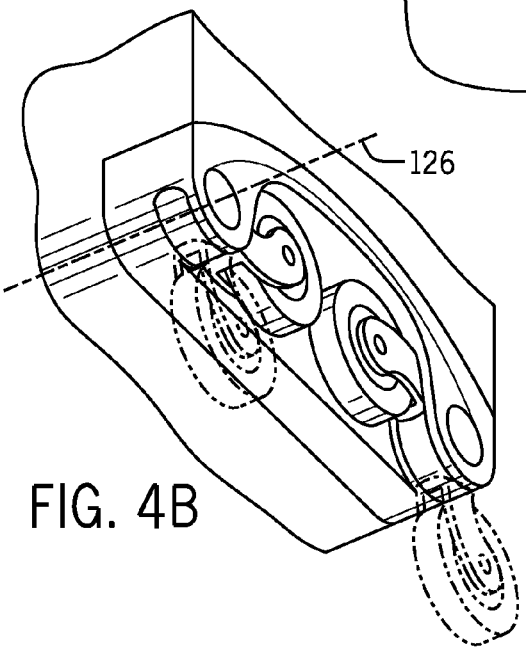
Figure 4C:
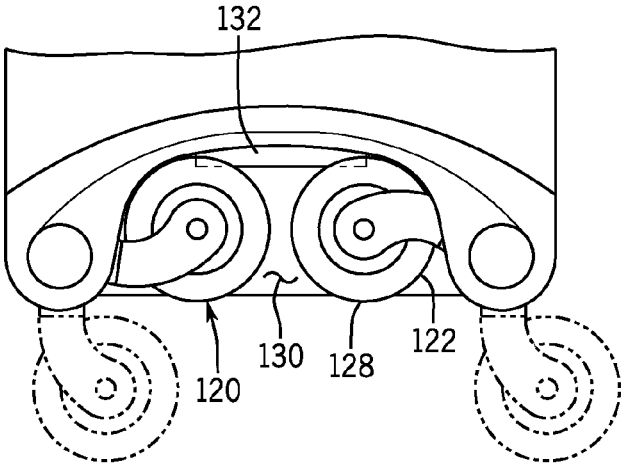

Turning to FIGS. 4A-4C, each spinner wheel assembly 120 may also be configured so that each spinner wheel 122 may be selectively pivoted about a spinner wheel pivot axis 126. The spinner wheel pivot axis 126 may be generally horizontal and perpendicular to one of the faces of the luggage case 100. This arrangement allows each spinner wheel 122 to be selectively moved from an operational or first position where a peripheral rim 128 of the spinner wheel 122 projects beyond a bottom end wall 112 of the luggage case 100 by a distance dl to a storage or second position where the peripheral rim 128 of the spinner wheel 122 does not project, or projects nominally, beyond the bottom end wall 112 of the luggage case 100. In the operational position, the projection of the peripheral rims 128 of the spinner wheels 122 beyond the bottom end wall 112 of the luggage case 100 allows the luggage case 100 to be supported on the ground by the spinner wheels 122 in a vertical upright orientation with the front, back, and side walls 102, 104, 106, 108, vertical and the top and bottom end walls 110, 112 generally horizontal with the ground, and further allows the luggage case 100 to be wheeled along the ground on the spinner wheels 122 in a generally vertical upright orientation. In the storage position, the luggage case 100 may be supported on the ground by its bottom end wall 112 in the vertical orientation since the peripheral rims 128 of the spinner wheels 122 do not project beyond the bottom end wall 112. While this prevents the luggage case 100 from being wheeled along the ground using the spinner wheels 122, this storage position for the spinner wheels 122 also allows the total height of the luggage case 100 to be minimized to the height of the front, back, and side walls 102, 104, 106, 108. This may be desirable for storing the luggage case 100, especially when the luggage case 100 is intended to be used as carry-on luggage. In other words, the capability to move the spinner wheels 122 between the operational and storage positions allows a user to utilize the spinner wheels for wheeling the luggage case 100 along the ground when moving the luggage case 100 and also allows the user to minimize the size of the luggage case 100 when storing the luggage case 100.

Figure 5A:
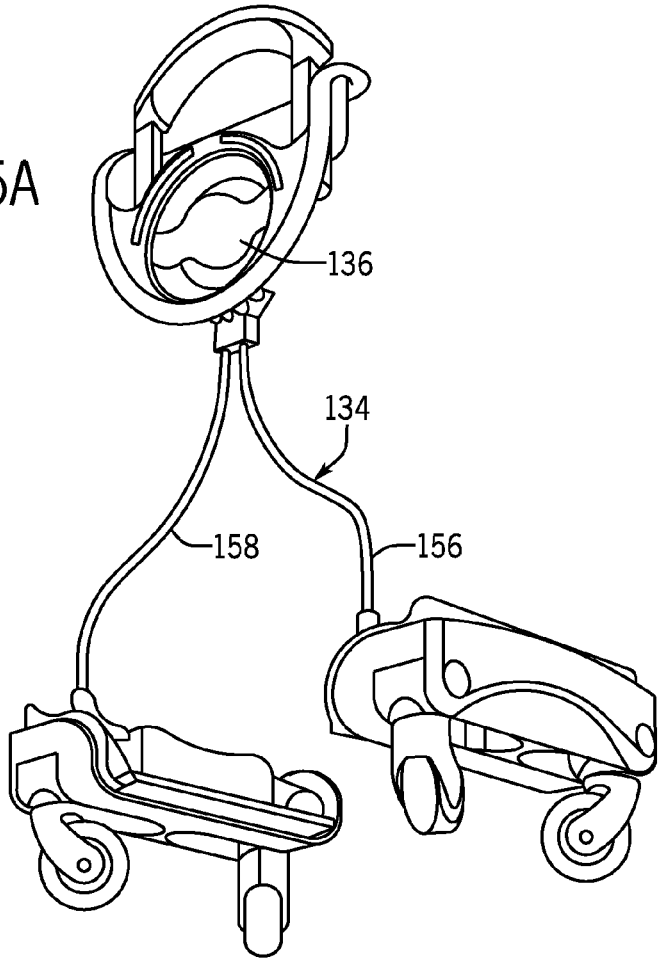
FIGS. 5A and 5B are schematic exploded views of an actuation mechanism for the luggage case shown in FIG. 1.
Figure 5B:
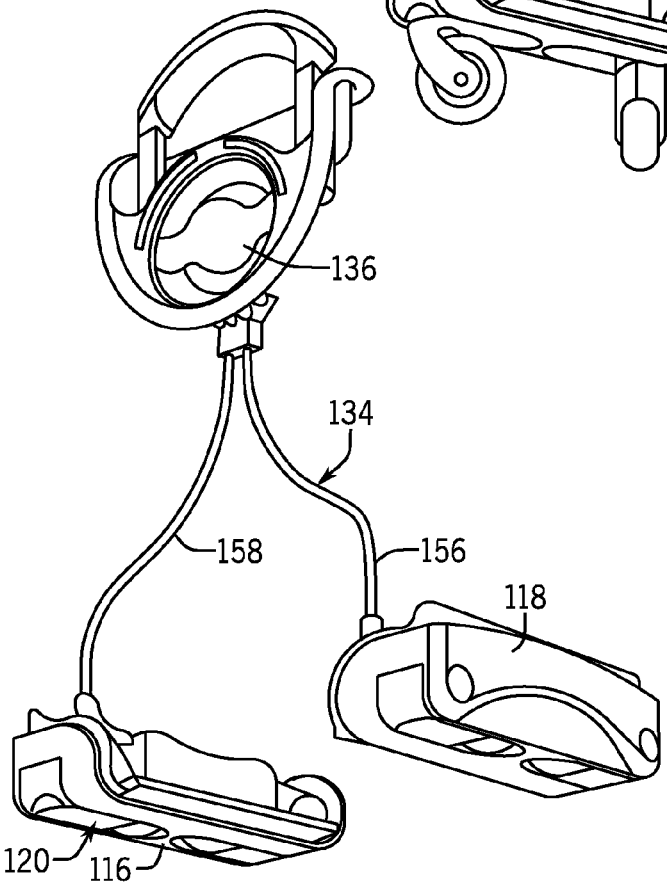

To allow the spinner wheels 122 of the spinner wheel assemblies 120 to not project beyond the bottom end wall 112 of the luggage case 100, one or more of the walls of the luggage case 100 may include spinner wheel recesses 130. In this embodiment, one spinner wheel recess 130 is primarily formed in the front wall 102, and the other spinner wheel is primarily formed in the back wall 104. Further, in this embodiment, the spinner wheel recesses 130, as shown in FIGS. 4B and 4C, are open on two sides. This may be advantageous as more open sides reduce the potential for the spinner wheels 122 to jam against one of the walls 102, 104, 106, 108, 112 of the luggage case 100 when being moved into their storage position. In such embodiments, an elongated rib 132 or other projection may extend downward from an upper surface that defines the spinner wheel recess 130. This elongated rib 132 may further be configured to be received within a gap between the adjacent wheels 122 of a spinner wheel assembly 120 when the spinner wheels 122 of the spinner wheel assembly 120 are positioned within the spinner wheel recess 130. Such an arrangement may keep the spinner fork bracket 124 of the spinner wheel assembly 120 from swinging back and forth around its vertical spinner axis. In other embodiments, the spinner wheel recesses 130 may be open on only one side (typically the bottom side), such as shown in FIGS. 5A and 5B. This configuration may be desirable when the luggage case 100 designer does not want the spinner wheels 122 to be readily visible and/or wants to reduce the potential for the spinner wheels 122 to snag other objects when positioned in their storage/retracted position.

The luggage case 100 may further include an actuation mechanism 134 to move the spinner wheels 122 between their operational and storage positions. The actuation mechanism 134 may include a user engagement component 136. The user engagement component 136 may be rotationally or pivotally joined to the back wall 104 of the luggage case 100. In this embodiment, the user engagement component 136 may be a dial or the like that can be rotated about a user engagement rotational axis 138 that is horizontal and perpendicular to the back wall 104 of the luggage case 100. Rotation of the dial about the user engagement rotational axis 138 moves the spinner wheels 122 between the operational and storage positions.

The luggage case 100 may also include a telescoping tow handle 140, which can be extended above the top end wall 110 of the luggage case 100 to an extended position at a convenient height for a user to hold. The tow handle 140 may be used to pull, direct, and wheel the luggage case 100. In particular in this embodiment, the tow handle 140 is oriented to have a grip portion 142 that parallels to the back face of the luggage case 100. The tow handle 140 in this embodiment telescopically extends from the luggage case 100 adjacent to, and in the center of, the back face of the luggage case 100. The tow handle 140 may include two parallel tubes 144 interconnected at a top end by the grip portion 142. The grip portion 142 may be curved with a lower facing, concave surface 146 that conforms to an upper facing, convex curved surface 148 of an upper tow handle housing 150 that encompasses the user engagement component 136. In other embodiments, the grip portion 142 may be substantially linear or any other desired shape. The tow handle 140 can be moved to a retracted position in which it does not substantially extend beyond the top end wall 110 of the luggage case 100 and in which an upper facing surface 152 of the grip portion 142 is generally flush and/or close to the top end wall 110. The luggage case 100 may also include one or more fixed carry handle(s) 154 to facilitate carrying or lifting the luggage case 100. A fixed carry handle 154 may be positioned on the right side wall 108 as shown or alternatively or additionally on the left side wall 106, the top wall 110, and/or the bottom end wall 112 of the luggage case 100.

Referring to FIGS. 5-9, the actuation mechanism 134 may further include a base (or first) actuation assembly 156 and a lid (or second) actuation assembly 158 operatively joined to the user engagement component 136. The base actuation assembly 156 is further operatively joined to the spinner wheel assemblies 120 attached to the base 118 of the luggage case 100 to translate rotational movement of the user engagement component 136 about its user engagement rotational axis 138 into pivotal movement of the spinner wheels 122 about their respective spinner wheel pivot axes 126, and the lid actuation assembly 158 is similarly operatively associated with the spinner wheel assemblies 120 attached to the lid 116 of the luggage case 100. The following discussion of the actuation mechanism 134 shall primarily focus on the components of the base actuation assembly 156. However, unless expressly stated otherwise, the lid actuation assembly 158 includes the same components. Further, unless stated otherwise, the discussion regarding the components of the base actuation assembly 156 are equally applicable to the components of the lid actuation assembly 158.

The base actuation assembly 156 may include one or more cables, springs, and pulleys that are assembled to move the spinner wheels 122 of the spinner wheel assemblies 120 attached to the base 118 between their operational and storage positions in response to rotation (or other movement) of the user engagement component 136. Specifically, the base actuation assembly 156 may include a first cable 160, a second cable 162, a spring or bias member 164, a first spinner wheel spring or bias member 166, a second spinner wheel spring or bias member 168, a first cam pulley 170, a second cam pulley 172, a first disc 174, a second disc 176, a fixed pulley 178, and a movable pulley 180. Generally, the majority of the components of the base actuation assembly 156 may be positioned near the back and bottom end walls 104, 112 of the luggage case 100, and thus may be positioned generally remote from the user engagement component 136, while the first cable 160 may extend from the user engagement component 136 that is positioned closer to the top wall 110 of the luggage case 100 to the spring 164 positioned near the bottom end wall 112 of the luggage case 100.

Figure 6A:
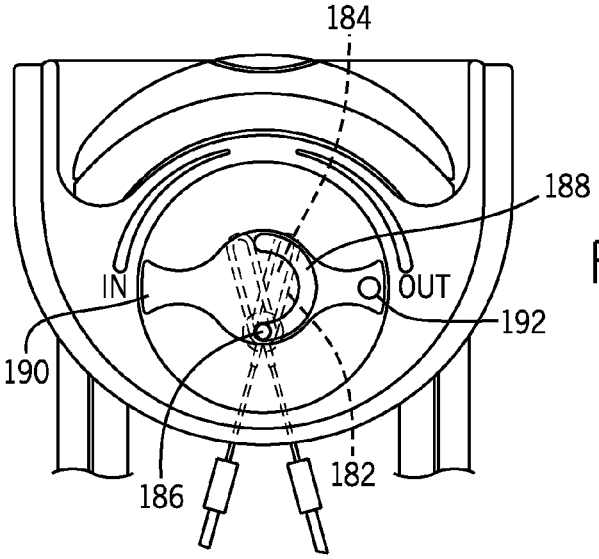
FIGS. 6A, 6B, and 6C are schematic elevation illustrations of a portion of the actuation mechanism for the luggage case shown in FIG. 1.
Figure 6B:
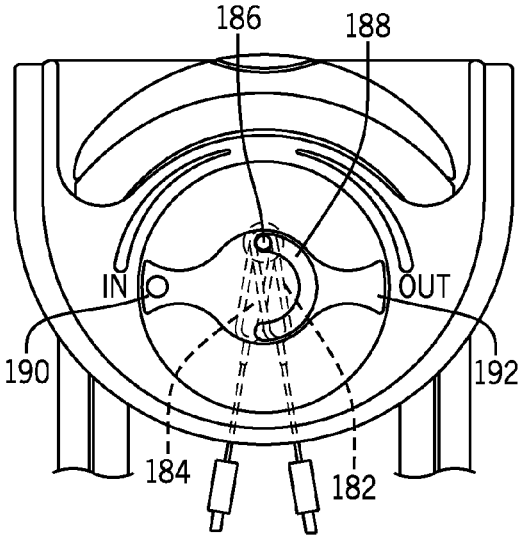
Figure 6C:
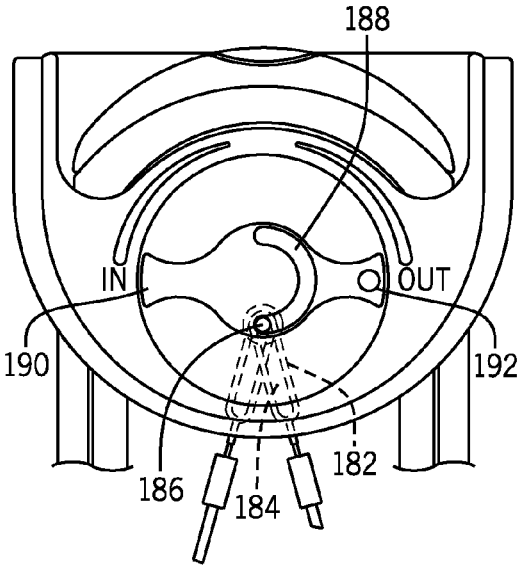

The first cable 160 may be a bicycle cable or any other suitable cable or wire. The cable or wire may be formed from a metal, such as steel, or any other suitable material. Referring to FIGS. 6A-6C, the end of the first cable 160 proximate the user engagement component 136 may include a first cable connector 182. The first cable connector 182 may generally take the form of an elongated plate-like element with an elongated slot 184. A user engagement pin, fastener, or other elongated member 186 may extend through the elongated slot 184, through a curved slot 188 formed in the tow handle housing 150 or other stationary member near the user engagement component 136, and through a hole sized slightly larger than the pin 186 in the user engagement component 136, thus joining the first cable 160 to the user engagement component 136. Alternatively, the user engagement pin, fastener, or other elongated member 186 could be connected, such as welded or the like, to the user engagement component 136 or could be integrally formed as part of the user engagement component 136. The curved slot 188 may generally take the shape of a 180 degree arc and may function as a guide for the user engagement pin 186 as the user engagement component 136 is rotated between the storage and operations positional for the spinner wheel assemblies 120. The curved slot 188 may also function to limit the range of rotation of the user engagement component 136. For example, as viewed from the back of the luggage case 100, the user engagement component 136 may be constrained to rotate in a clockwise direction from a first position 190 that corresponds to a storage position of the spinner wheels 122 to a second position 192 that corresponds to an operational position of the spinner wheels 122 and may be constrained to rotate in a counter clockwise direction from its second position 192 to its first position 190.

In some situations, one or more of the spinner wheels 122 may not pivot from their storage position to their operational position in response to rotation of the user engagement component 136 from the first position 190 to the second position 192. Such a situation may occur, for example, when the luggage case 100 is heavily loaded and placed on the ground in an upright orientation with the bottom end wall 112 supporting the luggage case 100. In this situation, the forces generated by the various springs in the base actuation assembly 156 may be insufficient to allow the spinner wheels 122 to pivot to their operational position from their storage position. However, even if the one or more of the spinner wheels 122 fail to move from their storage position to their operational position in response to rotation of the user engagement component 136, the elongated slot 184 in the connector 182 allows the user engagement component 136 to be rotated from the first position 190 to the second position 192.

Specifically, when the user engagement component 136 is located in the first position 190, the user engagement pin 186 is generally located at the upper portion of the curved slot 188 of the user engagement component 136 and is also located at the upper portion of the elongated slot 184. In normal operation, as the user engagement component 136 is rotated from the first position 190 to the second position 192, the pin 186 moves from the upper portion of the curved slot 188 to the lower portion of the curved slot 188. As the pin 186 moves from the upper portion to the lower portion of the curved slot 188, the upper portion of the first cable connector 182 also moves from the upper portion of the curved slot 188 to the lower portion of the curved slot 188.

However, if the spinner wheels 122 associated with the first cable 160 do not deploy from their storage position to their operational position, the upper portion of the first cable connector 182 will remain at the upper portion of the curved slot 188 (see FIG. 6A). Despite the lack of movement of the upper portion of the first cable connector 182, the pin 186 joined to the user engagement component 136 will still move from the upper portion of the curved slot 188 to the lower portion of the curved slot 188 because the pin 186 will slide from the upper portion of the elongated slot 184 to the lower portion of the elongated slot 184. This, in turn, allows the user engagement component 136 to be rotated from the first position 190 to the second position 192. Once the user engagement component 136 is moved to the second position 192, the user may then resolve the issue of the non-deployment of the spinner wheels 122 from their storage position to their operational position. For example, if non-deployment is occurring because the bottom end wall 112 is contacting the ground, the user may lift the luggage case 100 off of the ground. Such lifting will often remove the forces opposing deployment of the spinner wheels 122, thus allowing the forces generated by the base actuation assembly 156 to pivot the spinner wheels 122 from their storage position to their operational position.

Figure 7A:
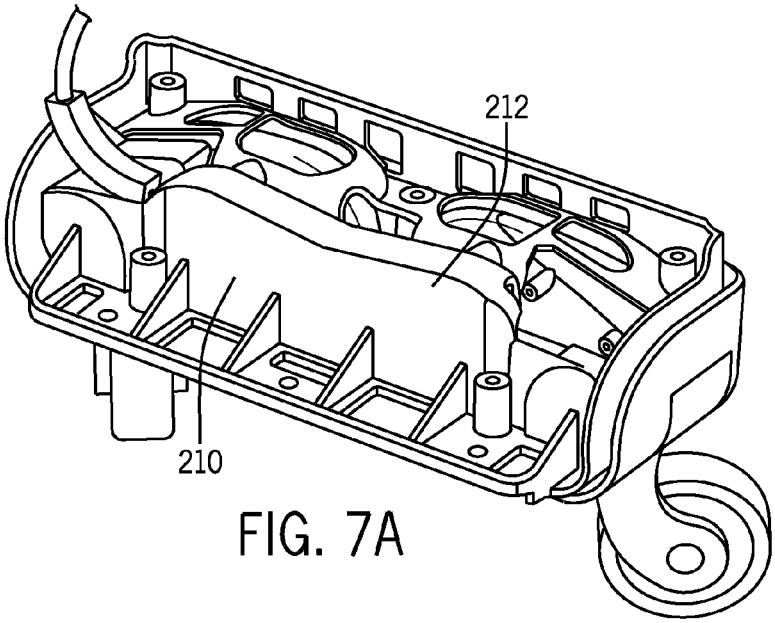
FIGS. 7A and 7B are schematic perspective illustrations of another portion of the actuation mechanism for the luggage case shown in FIG. 1.
Figure 7B:
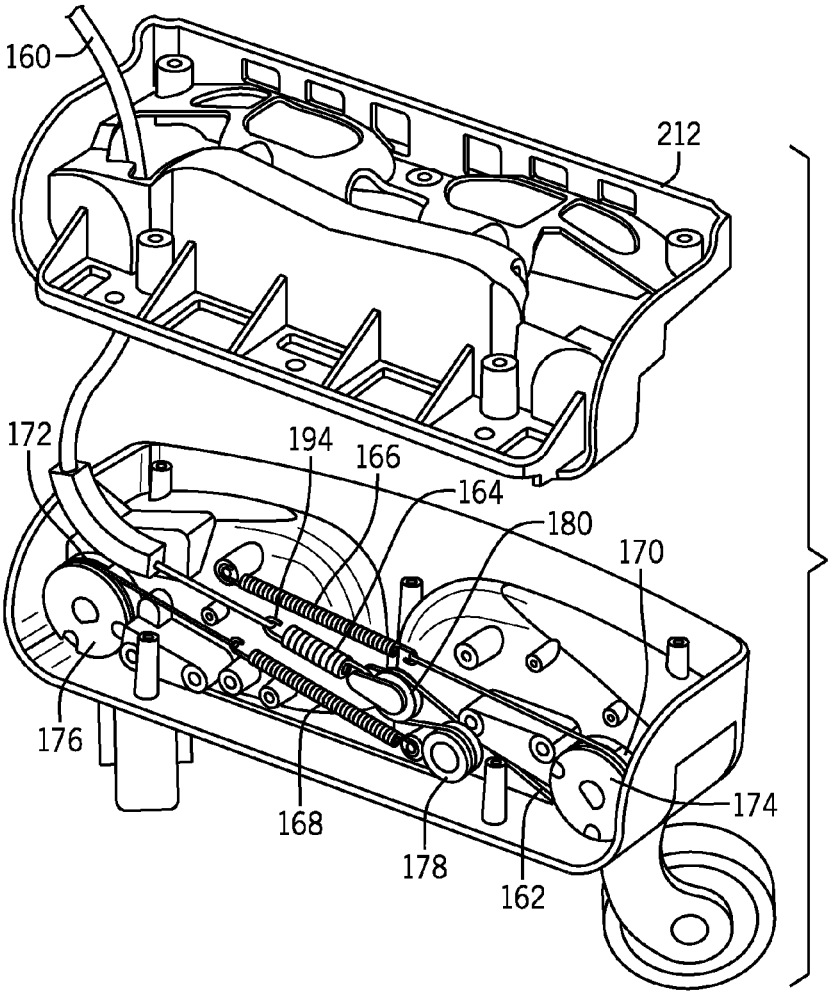
Figure 8A:
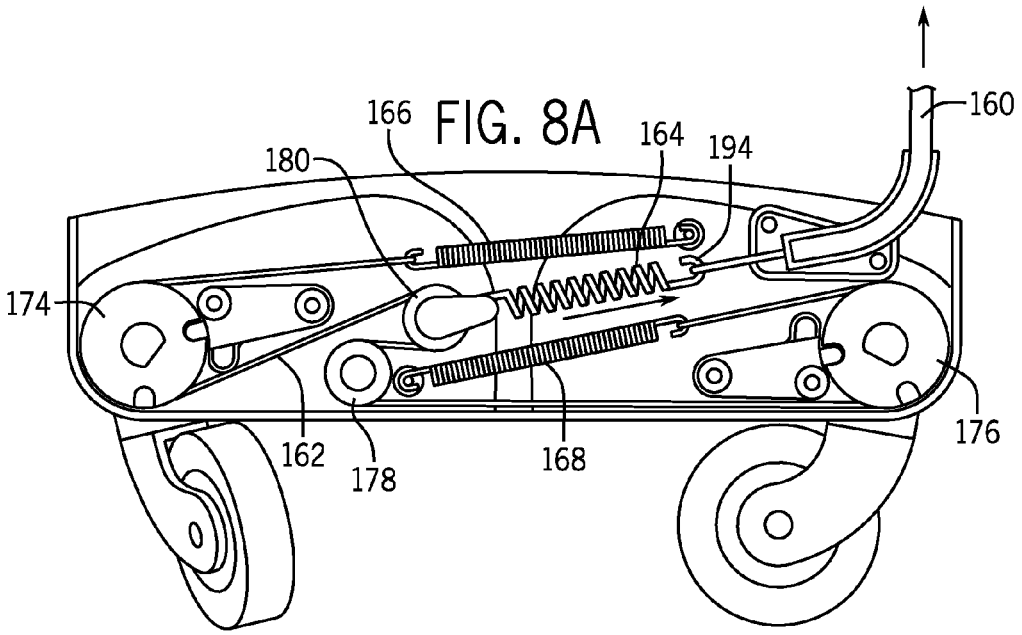
FIGS. 8A, 8B, and 8C are schematic elevation illustrations for the portion of the actuation mechanism shown in FIGS. 7A and 7B, the various illustrations showing various positions of the various components of the actuation mechanism for different operating states of the actuation mechanism.
Figure 8B:
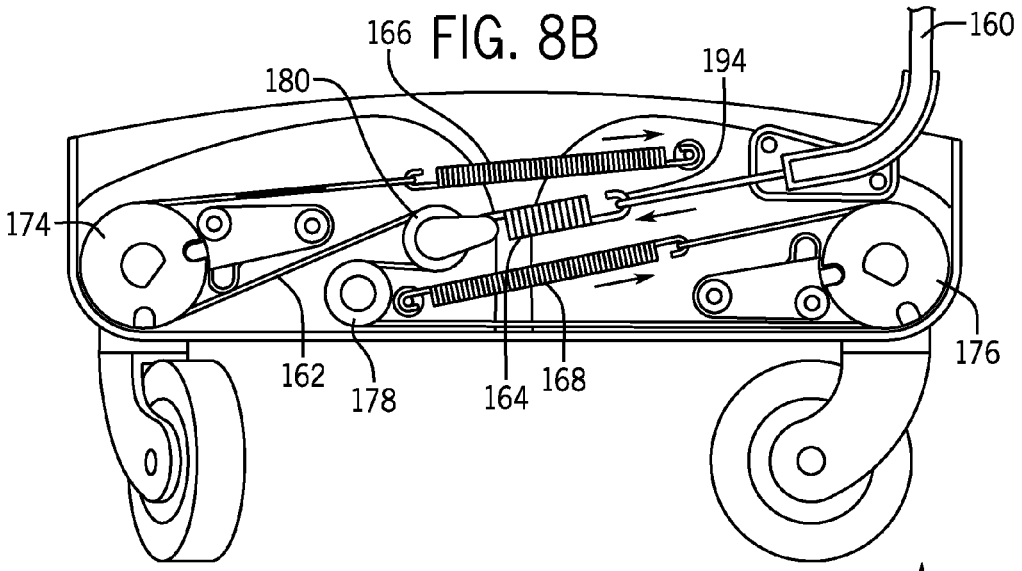
Figure 8C:
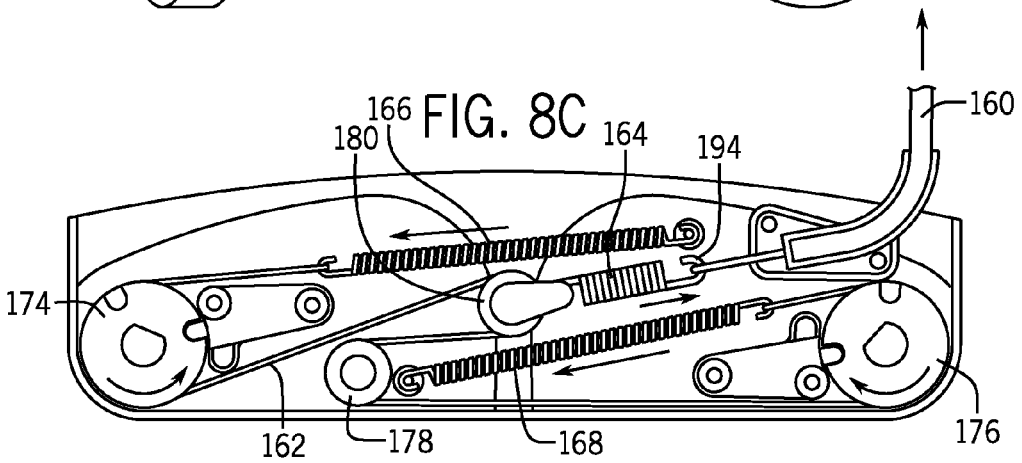
Figure 9:
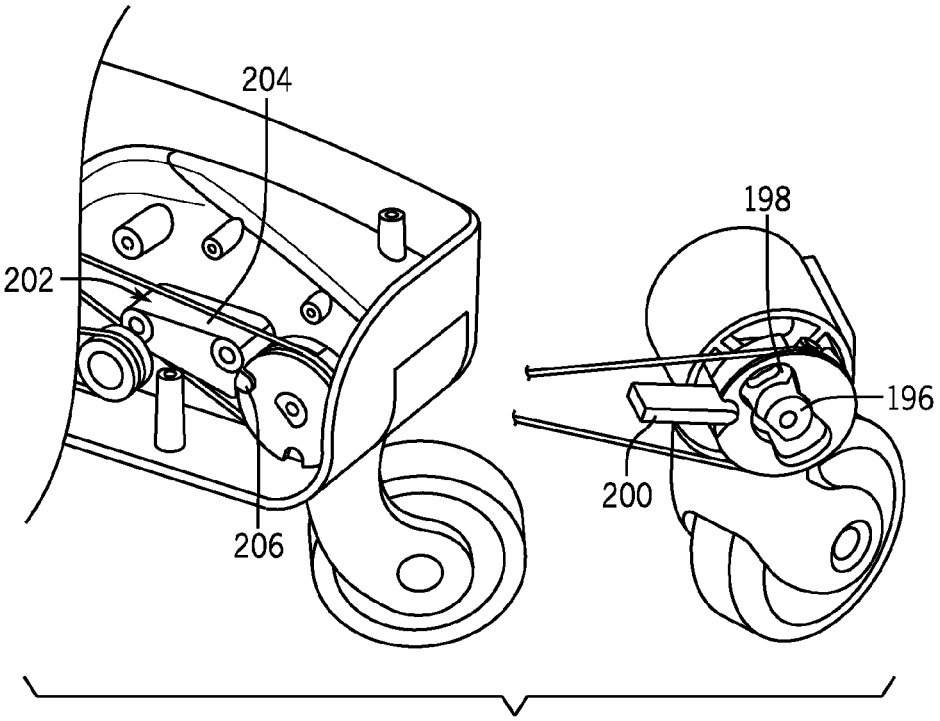
FIG. 9 is a schematic perspective illustration of a portion of the actuation mechanism.

Referring to FIGS. 7 to 9, the end of the first cable 160 near the bottom end wall 112 of the luggage case 100 may be joined to the spring 164 at a first end of the spring 164. To facilitate joining the first cable 160 to the spring 164, the first cable 160 may include another cable connector 194, which may define a circular or other suitably shaped hole or the like. The spring 164, in turn, may include a second end that is distal from the first end of the spring 164. At this second end, the spring 164 may be joined to the movable pulley 180.

The second cable 162 may include a first end and a second end distal the first end. The first end of the second cable 162 may be joined to the first spinner wheel spring 166, and the second end of the second cable 162 may be joined to the second spinner wheel spring 168. Like the first cable 160, the second cable 162 may include suitable connectors at its first and second ends to facilitate joining the second cable 162 to the first and second spinner wheel springs 166, 168.

Between the first and second ends of the second cable 162, the second cable 162 may be at least partially wrapped around the first and second cam pulleys 170, 172, the fixed pulley 178, and the movable pulley 180. Further, the second cable 162 may be anchored to the first and second cam pulleys 170, 172. Specifically, at each cam pulley 170, 172, the second cable 162 may be positioned between an outer facing surface of the cam pulley 170, 172 and a washer. A fastener or the like, such a screw or a bolt, may then be joined to the cam pulley 170, 172 to press the washer against the second cable 162 and the outer surface of the cam pulley 170, 172 in order to anchor the second cable 162 to the cam pulley 170, 172. Such anchoring results in each cam pulley 170, 172 rotating about its respective cam pulley rotation axis in response to movement of the second cable 162 as described below.

The first and second spinner wheel springs 166, 168 may each be joined to one of the walls of the luggage case 100 at ends that are distal from the ends of each spinner wheel spring 166, 168 that are joined to the second cable 162. For the first and second spinner wheel springs 166, 168 of the base actuation assembly 156, the first and second spinner wheel springs 166, 168 may typically be joined to the back wall 104, although the spinner wheel springs 166, 168 may alternatively be joined to other walls, such as the bottom end wall 112 of the luggage case 100. Further, the first and second spinner wheel springs 166, 168 may be generally configured in relationship to the other components of the base actuation assembly 156 to bias their respective spinner wheels 122 to their operational position. The first and second spinner wheel springs 166, 168 generally have much less stiffness than the spring 164. In some embodiments, the spring 164 may be three or more times stiffer than the first and second spinner wheel springs 166, 168.

The fixed pulley 178 may be joined to one of the walls of the luggage case 100 to rotate around a generally horizontal rotation axis. Typically, the fixed pulley 178 for the base actuation assembly 156 may be joined in a rotatable manner to the back wall 104 of the luggage case 100. The fixed pulley 178 may function primarily to redirect a portion of the second cable 162 located between the movable pulley 180 and the first cam pulley 170.

Each cam pulley 170, 172 may be positioned onto a pulley shaft 196 that is joined to the spinner wheel base or another component of the spinner wheel assembly 120 associated with the cam pulley 170, 172. Each cam pulley 170, 172 may further include a hole sufficiently large and sufficiently shaped to receive its respective pulley shaft 196 therethrough to allow each pulley cam 170, 172 to freely rotate about its respective pulley shaft 196.

Each disc 174, 176 may also be positioned onto the pulley shaft 196 associated with the disc 174, 176. Each disc 174, 176 may include a hole sufficiently large and sufficiently shaped to receive its respective pulley shaft 196 therethrough and to constrain each pulley shaft 196 to rotate with its respective disc 174, 176. In particular, each pulley shaft 196 may include a generally non-circular shaped cross-section, such as a D-shaped cross-section or the like, that is received within a similarly shaped hole formed in its associated disc 174, 176.

Each disc 174, 176 may further be located adjacent to its respective cam pulley 170, 172. Further, each disc 174, 176 may be joined to its respective cam pulley 170, 172 so that each cam pulley 170, 172 may rotate a select amount relative to its respective disc 174, 176 and, after rotating this selective amount, engage its respective disc 174, 176 so that both the cam pulley 170, 172 and its respective disc 174, 176 rotate together. To achieve such a function, each cam pulley 170, 172 may include one or more curved slots 198 that are arranged concentrically with the center of rotation of the cam pulley 170, 172 about its respective pulley shaft 196. In this embodiment, each cam pulley 170, 172 includes two curved slots 198. However, in other embodiments, each cam pulley 170, 172 may have more or less than two curved slots 198. A disc fastener, such as a screw or a bolt, is then passed through each cam pulley slot and joined to the disc. The disc fasteners thus join the discs 174, 176 to their respective cam pulleys 170, 172 while also allowing each cam pulley 170, 172 to be selectively rotated relative to its respective disc 174, 176 within a range of rotation that is proportional to the length of the cam pulley slots 198. The range of rotation may be selected to allow each cam pulley 170, 172 to be rotated sufficiently relative to its respective disc 174, 176 to disengage a lock member 200 from the disc 174, 176. In some embodiments, this range of rotation may be selected to be approximately 26 degrees. In other embodiments, the range of rotation may be greater or less than 26 degrees.

Once the disc fastener reaches an end of the curved slot 198 by relative rotation of the cam pulley 170, 172 to its respective disc 174, 176, the disc fastener engages the end of the curved slot 198 and thus causes the disc 174, 176, to which it is joined, to rotate with the disc's respective cam pulley 170, 172 as long as the cam pulley 170, 172 continues to be rotated in the same direction that resulted in the disc fastener contacting the end of the cam pulley curved slot 198. This rotation of the disc 174, 176 then causes rotation of its respective pulley shaft 196, which in turn causes pivoting of the spinner wheels 122 associated with the pulley shaft 196 between either their operational and storage position, or vice versa, depending upon the direction of rotation of the cam pulley 170, 172.

In some embodiments, fastener posts or the like may extend transversely away from each disc 174, 176 and may include apertures or the like to receive the disc fasteners therein to allow for a potentially more robust connection of the disc fasteners with their respective discs 174, 176. In such embodiments, the fastener posts may be positioned through the cam pulleys slots 198 and may serve a similar function as the disc fastener with respect to the rotation features of the cam pulley 170, 172 and its respective disc 174, 176.

Referring to FIG. 9, a lock assembly 202 may be associated with each cam pulley 170, 172 and disc 174, 176. The lock assembly 202 for the first cam pulley 170 and the first disc 174 will be described. However, the following discussion should be understood to be equally applicable for a second lock assembly 202 associated with the second cam pulley 172 and the second disc 176. The first lock assembly 202 may include the lock member 200, a lock member housing 204, and a lock bias member. The lock member 200 may be a generally cuboid shaped member with a generally first curved end. The curved end of the lock member 200 may be biased by the lock bias member to project outwardly from the lock member housing 204 by positioning the bias member between an inner surface of the lock member housing 204 and the end portion of the lock member 200 that is distal from its curved end. Further, a bias member hole may be formed in this end portion of the lock member 200 to receive at least a portion of the lock bias member therein, which may facilitate maintaining the relative position of the lock bias member relative to the lock member 200. The lock member housing 204, in turn, may be configured so that the lock member 200 may slide relative to the lock member housing 204 to increase and decrease the portion of the lock member 200 that extends outwardly from the lock member housing 204.

The curved end portion of the lock member 200 may be sized to be received within a disc lock slot 206 formed in the first disc 174 and a cam pulley lock slot 208 formed in the first cam pulley 170. When the curved end portion of the lock member 200 is received within the disc lock slot 206, rotation of the first disc 174 around the rotation axis defined by its pulley shaft 196 is prevented. This, in turn, prevents pivotal rotation of the spinner wheels 122 associated with the first disc 174 via the pulley shaft 196. Further, the first disc 174, the lock assembly 202, and the spinner wheel assembly 120 may be configured so that the spinner wheels 122 are deployed in their operational position when the curved end portion of the lock member 200 is received within the disc lock slot 206. Such an arrangement allows for the spinner wheels 122 to remain locked in their operational position unless the user engagement mechanism 136 is utilized to move the spinner wheels 122 from their operational position to their storage position.

To unlock the spinner wheels 122 in order to move the spinner wheels 122 from their operational position to their storage position, the disc lock slot 206 and the cam pulley lock slot 208 may be positioned on their respective members 174, 170 such that the curved end portion of the lock member 200 may be received concurrently in the disc lock slot 206 and the cam pulley lock slot 208. The cam pulley lock slot 208 may then include a sloped cam face. When the curved end portion of the lock member 200 is received within the cam pulley lock slot 208, the sloped cam face may engage the curved end portion of the lock member 200 as the first cam pulley 170 is rotated in a direction that is intended to cause the associated spinner wheels 122 to move from their operational position to their storage position. As the sloped cam face engages the lock member 200, the lock member 200 may be moved towards the lock member housing 204 to reduce the amount of projection of the curved end of the lock member 200 from the lock member housing 204. The sloped cam surface may further be configured so upon sufficient rotation of the first cam pulley 170, the curved end portion of the lock member is completely removed from the disc lock slot 206 and the cam pulley lock slot 208. Removal of the curved end portion of the lock member 200 from both of these lock slots 206, 208 then allows the first disc 174 to be rotated around its rotational axis, which in turn allows the spinner wheels 122 to pivot relative to the luggage case 100.

Once unlocked, the spinner wheels 122 can be re-locked into their operational position by moving the spinner wheels 122 back to their operational position. More particularly, as the first cam pulley 170 is rotated about its rotational axis in a direction that moves the spinner wheels 122 from their storage position to their operational position, the first disc 174 associated with the first cam pulley 176 is rotated. These two members are rotated until the spinner wheels 122 reach their operational position. Upon reaching the operational position, the disc lock slot 206 and the cam pulley lock slot 208 longitudinally align with the lock member 200. This alignment allows the lock bias member to push the curved end portion of the lock member 200 back into the disc lock slot 206 and the cam pulley lock slot 208. Once the curved end portion of the lock member 200 is re-positioned with the disc lock slot 206, the first disc 174 is prevented from rotating about its rotational axis, which in turn prevents pivotal movement of the spinner wheels 122 about the spinner wheel pivot axis 126.

If desired, the lock assembly 202 may be omitted. In such embodiments, the spinner wheels 122 may be locked into their operational positions by another method. For example, the user engagement component 136 may be designed to remain in its second position 192 unless a user exerts a sufficient minimal force to move the user engagement component 136 from its second position 192 to its first position 190. This could be done, for example, by including a detent 214 with the user engagement component 136. The detent 214 may be configured to prevent rotation of the user engagement component 136 from its second position 192 unless at least a pre-determined minimal amount of force is applied by the user. Further, in embodiments where a lock assembly 202 is omitted, the discs 174, 176 may also be omitted and the cam pulleys 170, 172 may be designed to be constrained to rotate with their respective pulley shafts 196 rather than be designed to freely rotate around their respective pulley shafts 196.

The base actuation assembly 156 may optionally include a base actuation housing 210. The base actuation housing 210 may contain the components of the base actuation assembly 156 that are positioned near the bottom end wall 112 of the luggage case 100. The base actuation housing 210 may be formed from a housing cover 212 and one or more walls of the luggage case 100, such as portions of the back, left, right, and bottom end walls 104, 106, 108, 112. Collectively, the housing cover 212 and the one or more walls 104, 106, 108, 112 may define a substantially enclosed space. This enclosed space may function to hide and/or protect the components of the base actuation assembly 156 that are positioned near to the bottom end wall 112 of the luggage case 100.

Referring to FIGS. 4 to 9, operation of the base actuation assembly 156 and the user engagement component 136 to move associated spinner wheels 122 from their operational position to their storage position will now be described. Starting in the operational position of the spinner wheels 122, the user engagement mechanism 136 may be rotated about its rotation axis 138 from the second position 192, which may be marked to identify it as the operational position for the spinner wheel assemblies 120 (e.g., "operational," "out," "deployed," and so on), to the first position 190 approximately 180 degrees from the second position 192, which may be marked to identify it as the storage position for the spinner wheel assemblies 120 (e.g., "storage," "in," "retracted," and so on). With particular reference to FIGS. 6A-6C, as the user engagement component 136 is rotated from the second position 192 to the first position 190, the end of the first cable 160 joined to the user engagement component 136 moves upward. Turning to FIG. 9, this upward movement of the first cable 160 causes the first cable 160 to pull the spring 164 from it starting position towards the end of the first cable 160 joined to the spring 164. Under normal operating conditions, the spring 164 is sufficiently stiff so that it moves from its initial position to a second position. As the spring 164 moves from its initial position to the second position, it also moves the movable pulley 180 joined to it from an initial position to a second position. This movement of the movable pulley 180 pulls the second cable 162, which is anchored to the first and second cam pulleys 170, 172.

As the second cable 162 is pulled by the movable pulley 180, the second cable 162 causes each of its respective cam pulleys 170, 172 to rotate about their respective pulley shafts 196 and rotate relative to their respective discs 174, 176. This rotation of the cam pulleys 170, 172 unlocks the lock members 200 associated with the cam pulleys 170, 172 from their associated discs 174, 176, thus allowing the discs 174, 176 to also rotate, and also elongates the spinner wheel springs 166, 168 that are associated the cam pulleys 170, 172 via the second cable 162. Each cam pulley 170, 172 continues to rotate until the disc fasteners positioned within the cam pulley slots 198 engage the ends of their respective cam pulley slots 198. Once engaged, the discs 174, 176 rotate with their associated cam pulleys 170, 172, thus rotating the associated pulley shafts 196. This, in turn, causes the spinner wheels 122 associated with the pulley shafts 196 to pivot around their respective spinner wheel pivot axes 126, thus pivoting the spinner wheels 122 from their operational position to their storage position.

As the spinner wheels 122 move from their operational position to their storage position, the spinner wheels 122 move into the spinner wheel recess 130 defined by the back and bottom end walls 104, 112 of the luggage case 100 if the spinner wheels 122 are properly aligned with the spinner wheel recess 130. However, if the spinner wheels 122 are not properly aligned, the spinner wheels 122 may become jammed against the bottom end wall 112 of the luggage case 100. The base actuation assembly 156, however, is designed to accommodate this potential jamming.

With reference to FIG. 8A, if jamming should occur, the user can continue to move the user engagement component 136 to the first position 190. In such a situation, the spring 164 joined to the first cable 160 will elongate to compensate for the inability of the cam pulley 170, 172 associated with the jammed spinner wheel 122 to continue rotating. This elongation of the spring 164 allows the user to continue to move the user engagement component 136 to the first position 190 without damaging any of the components of the base actuation assembly 156. Upon completing movement of the user engagement mechanism 136 to the first position 190, the user may observe the jamming of any spinner wheels 122 against the bottom end wall 112. To correct this issue, the user may pull any jammed spinner wheels 122 away from the bottom end wall 112 and align the spinner wheels 122 with the spinner wheel recess 130. Upon releasing the properly aligned spinner wheels 122, the elongated spring 164 will contract. As the elongated spring 164 contracts, it will pull the movable pulley 180 towards itself. This pulling of the movable pulley 180 will pull on the second cable 162, which will cause the cam pulleys 170, 172 to rotate. This rotating of the cam pulleys 170, 172 will then rotate their associated discs 174, 176, thus completing the pivoting of the spinner wheels 122 to their storage position.

With reference to FIGS. 4B and 4C, the spinner wheel assemblies 120 and the spinner wheel recess 130 may be configured so that the spinner wheels 122, when aligned to be generally parallel to the length of the spinner wheel recess 130, may be rotated inward as shown on the left side of the figure or outward as shown on the right side of the figure. When rotated inward, the spinner wheels 122 will generally require less pivotal movement relative to the back wall 104 to be fully received within the spinner wheel recess 130 than required when the spinner wheels 122 are rotated outward.

The design of the base actuation assembly 156 also accommodates this situation as the distance that the movable pulley 180 moves will automatically adjust to allow for different relative movements of the second cable 162 between the movable pulley 180 and the cam pulleys 170, 172.

Additionally, the base actuation assembly 156 is configured to accommodate movements of the user engagement component 136 from the second position 192 to the first position 190 that are greater than what is required to move the spinner wheels 122 of the spinner wheels assemblies 120 into the spinner wheel recess 130. For example, once the spinner wheels 122 are positioned within the spinner wheel recess 130, the spinner wheels 122 will engage the upper wall of the spinner wheel recess 130. This engagement will prevent further pivotal movement of the spinner wheels 122. This, in turn, will prevent further rotation of the cam pulleys 170, 172 associated with the spinner wheels 122. If this occurs before the user finishes moving the user engagement component 136 from the second position 192 to the first position 190, the first end of the first cable 160 will continue to move upward, which will cause the distal end of the first cable 160 to continue to pull on the spring 164. Because the cam pulleys 170, 172 are now constrained from further rotations by the spinner wheels 122, the movable pulley 180 will stop moving in a direction towards the spring 164. However, the spring 164 will then elongate to accommodate the pulling of the first cable 160, thus allowing the user to complete rotation of the user engagement component 136 to the first position 190.

To return the spinner wheels 122 to their operational position, the user engagement component 136 may be rotated from its first position 190 back to its second position 192. As the user engagement component 136 is rotated back to its second position 192, the tension in the first cable 160 is reduced as the first end of the first cable 160, under normal operation, moves downward. The first and second spinner wheel springs 166, 168, which are now elongated, seek to contract, and thus cause their cam pulleys 170, 172 to rotate from their second positions back to their first positions. As the cam pulleys 170, 172 rotate, the cam pulleys 170, 172 cause rotation of their associated discs 174, 176. The rotation of the discs 174, 176 causes rotation of their associated pulley shafts 196, which pivot the spinner wheels 122 associated with the pulley shafts 196 from their storage position back to their operational position. As the user completes movement of the user engagement component 136 to the second position 192, the spinner wheels 122 complete their pivotal movement to their operational position. Further, the cam pulley lock slot 208 and the disc lock slot 206 move into alignment with the lock member 200, thus resulting, as described above, in the lock member 200 re-engaging its respective disc 174, 176. This re-engagement with the disc 174, 176 locks the associated spinner wheels 122 in their operational position.

As described above, under certain circumstances, the forces applied by the spinner wheel springs 160, 168 may not be sufficient to cause rotation of the cam pulleys 170, 172. However, as described above, the user may continue to rotate the user engagement component 136 to the second position 192 even if the spinner wheels 122 do not deploy to their operational position. In particular, the first end of the first cable 160 will simply not move downward while the pin 186 positioned within the elongated slot 184 of the connector 182 for the first cable 160 will move downward to allow for continued rotation of the user engagement component 136 to the second position 192. Once the user engagement component 136 is positioned in the second position 192, the user can attempt to identify the reason for non-deployment of the spinner wheels 122 and take appropriate remedial actions to deploy the spinner wheels 122. For example, as described above, the issue may be the luggage case 100 resting on the bottom end wall 112 in an upright orientation. In this situation, the ground may be exerting a force on the spinner wheels 122 that is sufficiently large to keep the spinner wheels 122 from deploying. The user can remove this force by lifting the luggage case 100 off the ground. Once removed, the forces applied by the spinner wheel springs 166, 168 can then rotate their respective cam pulleys 170, 172 to cause the associated spinner wheels 122 to pivot to their operational position.

Figure 10A:
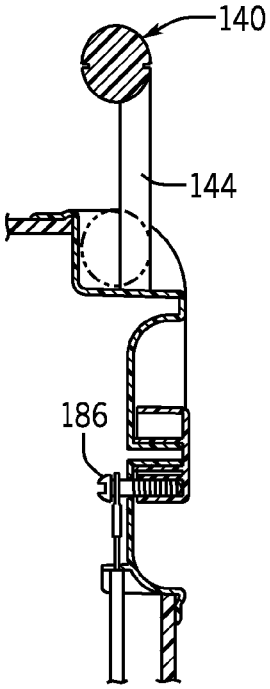
FIGS. 10A and 10B are schematic elevation illustrations of the actuation mechanism showing the user engagement component with a detent 214.
Figure 10B:
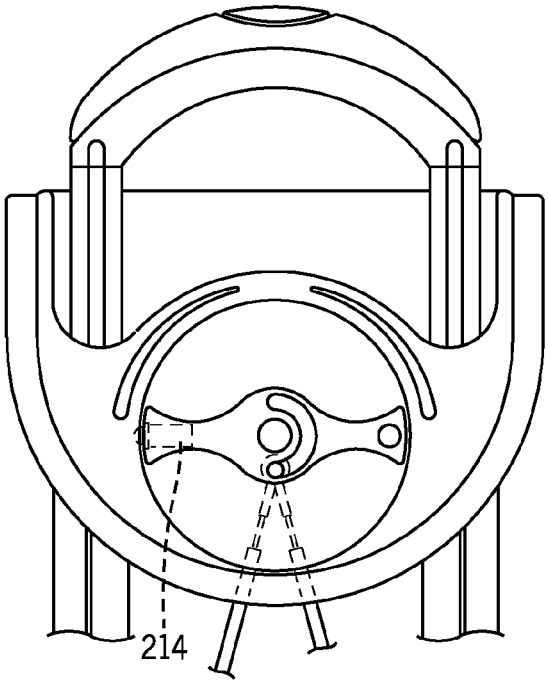

FIGS. 10A and 10B show the user engagement component 136 with a detent 214. The detent 214 may be a ball plunger or other suitable detent that can selectively be received within depressions or recesses formed on the upper tow handle housing 150 and may be positioned in a recess formed in the main body of the user engagement component 136. The depressions may be formed at locations on the upper tow handle housing 150 that correspond to the first and second positions 190, 192 of the user engagement component 136. In such an arrangement, the detent 214 may function to maintain the user engagement component 136 in the first or second position 190, 192 until a user applies a sufficient force to rotate the user engagement component 136 out of its first or second position 190, 192. The detent 214 may also function to provide an indication to a user when the user engagement component 136 has been moved to the first position 190 or the second position 192, or vice versa.

Figure 11A:
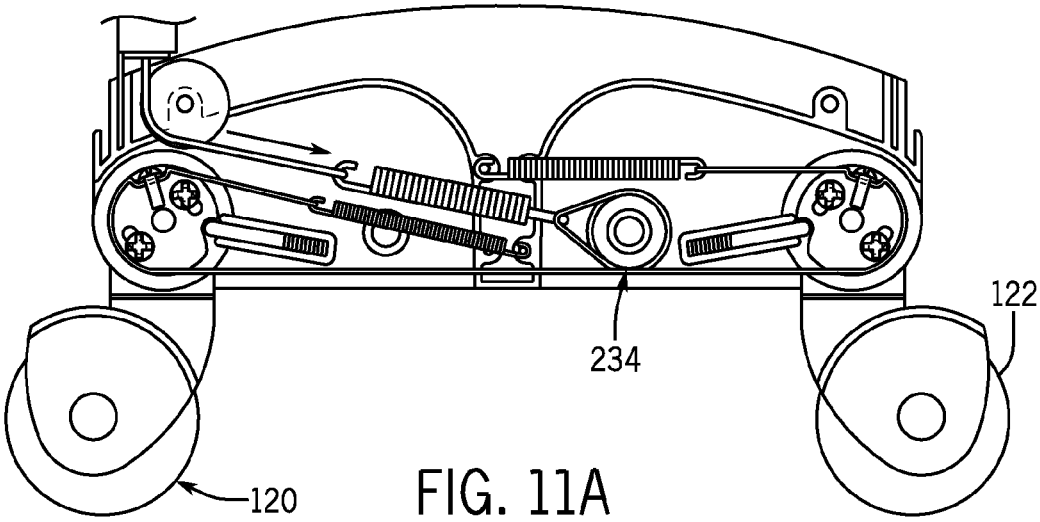
FIGS. 11A and 11B are schematic elevation views of a portion of a second embodiment of the actuation mechanism.
Figure 11B:
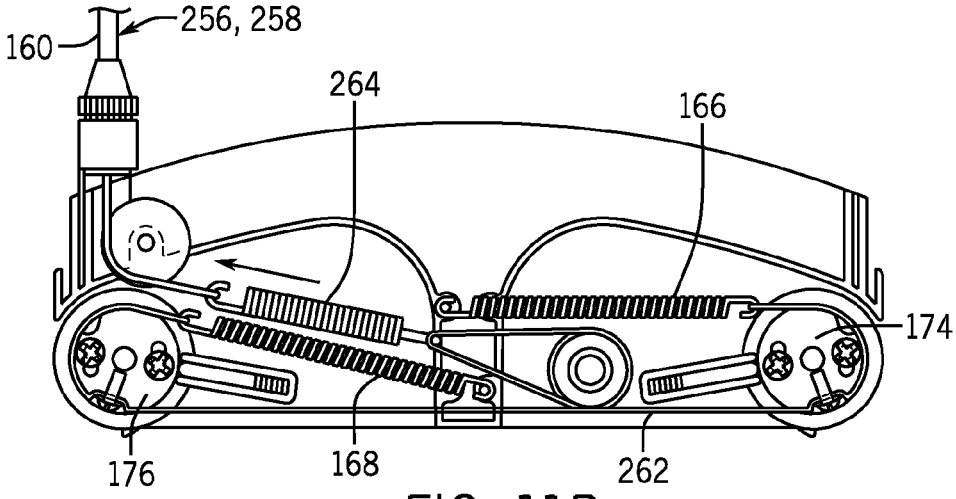

FIGS. 11A and 11B show another embodiment of an actuation mechanism 234. The second actuation mechanism 234 is generally similar to the first actuation mechanism 134. Like the first actuation mechanism 134, the second actuation mechanism 234 may include a user engagement component 136 joined to a base actuation assembly 256 and a lid actuation assembly 258. However, the base and lid actuation assemblies 256, 258 differ slightly from the base and lid actuation assemblies 156, 158 for the first embodiment of the actuation mechanism. In particular, the movable pulley is omitted and the second cable 262 is joined directly the spring 264. Other than this change, the second actuation mechanism 234 is substantially similar to the first actuation mechanism 134 and operates in a manner similar to the first actuation mechanism 134. In particular, as the user engagement component 136 is rotated from the second position 192 to the first position 190, the first cable 160 is pulled upward. This upward movement of the first cable 160 pulls on the second cable 262 via the spring 264. As the second cable 262 is pulled, the cam pulleys 170, 172 rotate relative to their respective discs 174, 176 to unlock the discs 174, 176 and then engage the discs 174, 176 to pivot the spinner wheel assemblies 120 in order to move the spinner wheel assemblies 120 from their operational position to their storage position. Similarly, rotating the user engagement component 136 from the first position 192 back to the second position 190 moves the first cable 160 downward, thus allowing the spinner wheel springs 166, 168 to rotate the cam pulleys 170, 172 in a direction that pivots the spinner wheels 122 from their storage position to their operational position.

Figure 12A:
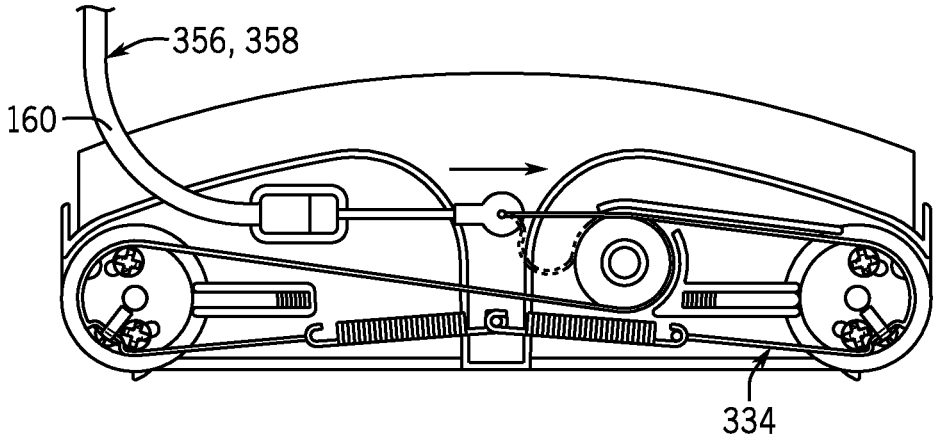
FIGS. 12A and 12B are schematic elevation views of a portion of a third embodiment of the actuation mechanism.
Figure 12B:
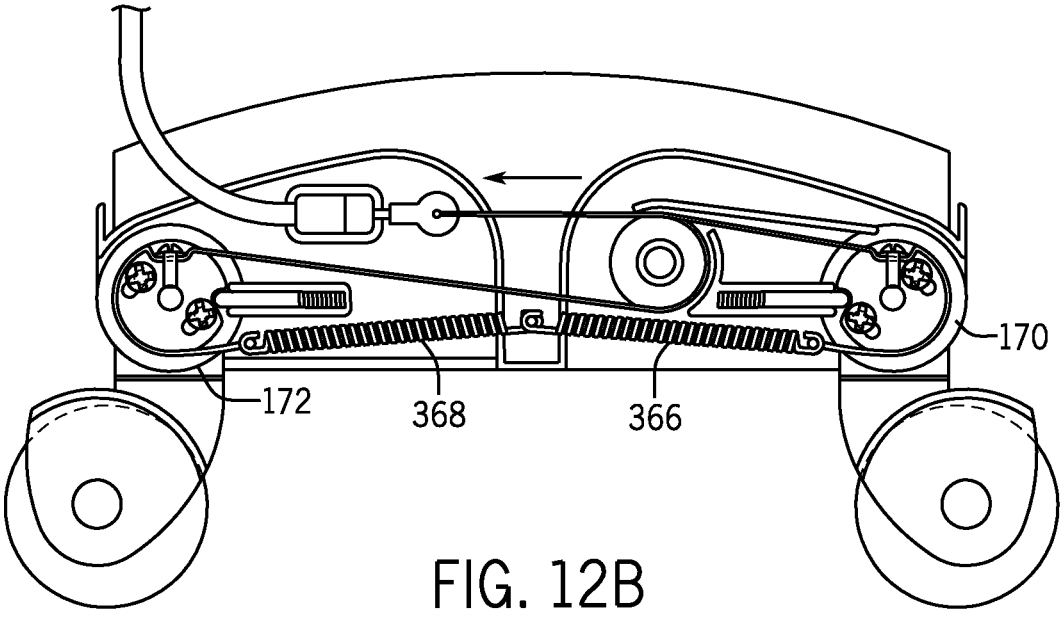
Figure 13A:
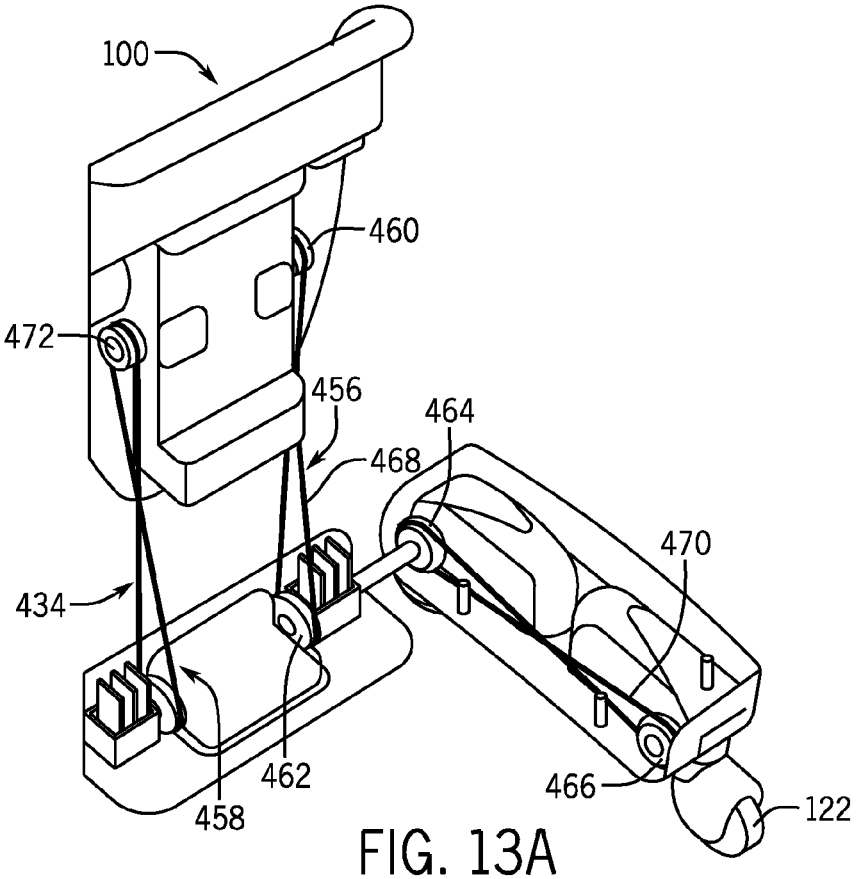
FIGS. 13A, 13B, 13C, and 13D are schematic illustrations of a fourth embodiment of the actuation mechanism.
Figure 13B:
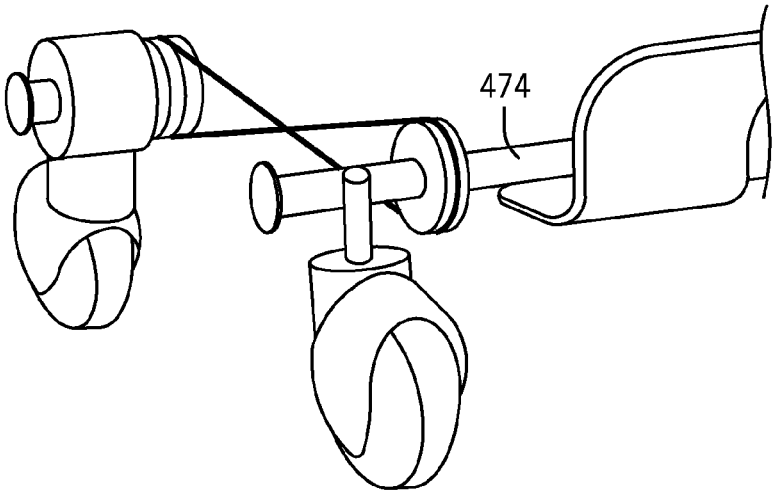
Figure 13C:
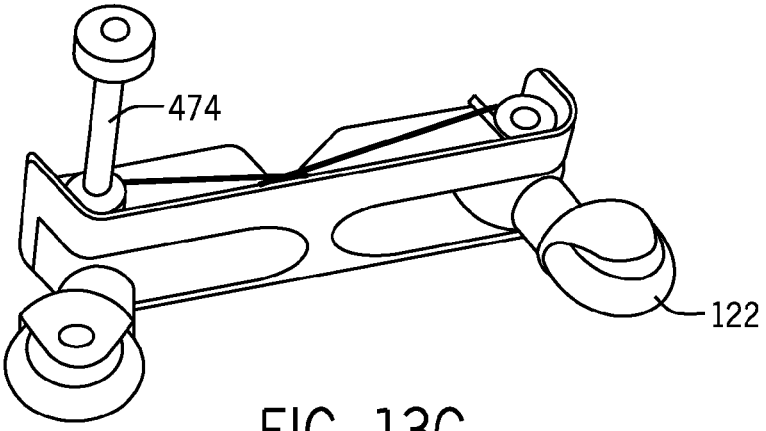
Figure 13D:
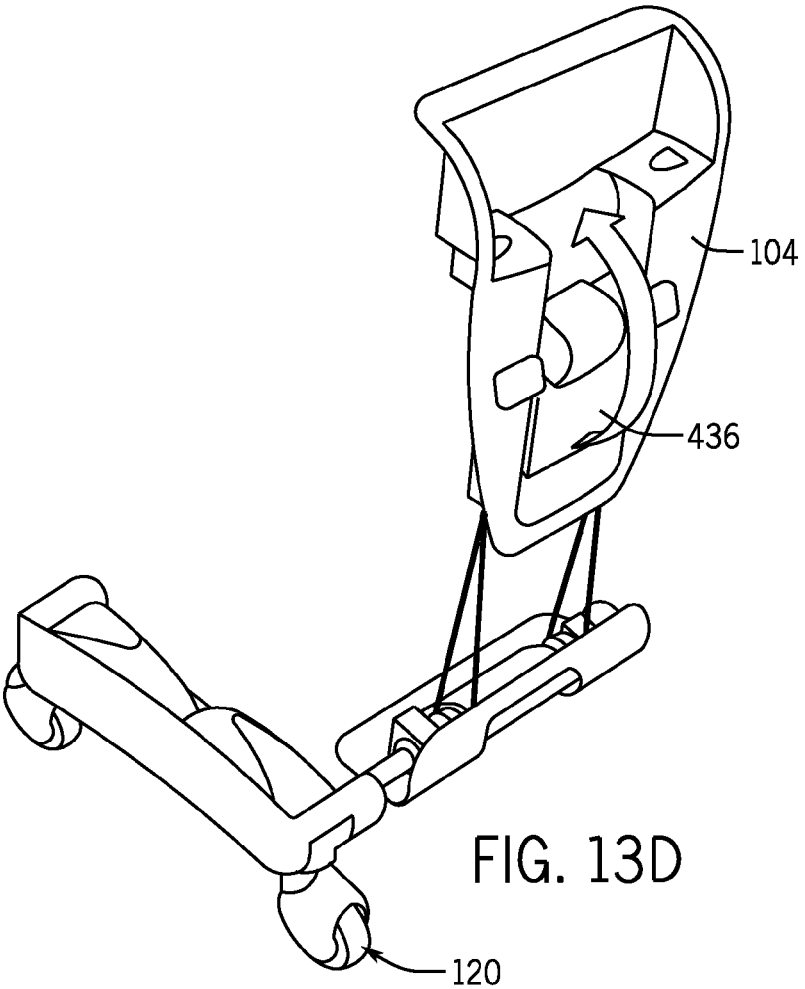

FIGS. 12A and 12B show a third embodiment of an actuation mechanism 334. Like the first and second actuation mechanisms 134, 234, the third actuation mechanism 334 includes a user engagement component 136 joined to a base actuation assembly 356 and a lid actuation assembly 358. Also, like the first and second actuation mechanisms 134, 234, the various components for the base and lid actuation assemblies 356, 358 may include various cables, pulleys, and springs configured to pivot the spinner wheels 122 in response to rotation of the user engagement component 136. However, the components of the base and lid actuation assemblies 356, 358 are configured so that as the first cable 160 is moved upward, the spinner wheels 122 pivot from their storage position to their operational position instead of from their operation position to their storage position. Further, when the user engagement component 136 is rotated in the opposite direction to move the first cable 160 downward, the spinner wheel springs 166, 168 rotate the cam pulleys 170, 172 in a direction that pivots the spinner wheels 122 from their operation position to their storage position. In other words, the spinner wheel springs 366, 368 for the base and lid actuation assemblies 356, 358 of the third actuation mechanism 334 are configured to bias the spinner wheels 122 towards their storage position in contrast to the spinner wheel springs 166, 168 for the base and lid actuation assemblies 156, 158, 256, 258 for the first and second actuation mechanisms 134, 136 that are configured to bias the spinner wheels 122 towards their operational position.

FIGS. 13A, 13B, 13C, and 13D show a fourth embodiment of an actuation mechanism 434 to move the spinner wheels 122 between their operational and storage positions. In this fourth embodiment, the user engagement component 436 may be a lever. The lever may be joined to one of the walls of the case, such as the back wall 104, to pivot around a pivot axis that is generally horizontal and parallel to the wall to which it is attached. In this arrangement, the lever can be pivoted from a position where its free end is located below the pivot axis to a positioned where its free end is located above the pivot axis, and vice versa. As the lever is moved between these two positions, the spinner wheels 122 move between their operational and storage positions.

The fourth actuation mechanism 434 may further include right (or first) and left (or second) actuation assemblies 456, 458 operatively joined to the user engagement component 436. The right side actuation assembly 456 will be described. This description, however, is equally applicable to the left side actuation assembly 458.

The right actuation assembly 456 may include an upper pulley 460, a lower pulley 462, a drive pulley 464, a slave pulley 466, a first cable 468, a second cable 470, a pivot axle 472, and a transfer axle 474. The upper pulley 460 may be joined to the pivot axle 472 in such a manner that the upper pulley 460 rotates in response to rotation of the pivot axle 472 around the pivot axle's central longitudinal axis. The pivot axle 472 may define the pivot axis for the user engagement component 436. Further, the user engagement component 436 may be joined to the pivot axle 472 in such a manner that pivotal movement of the user engagement component 436 causes a corresponding rotation of the pivot axle 472 about the pivot axle's central longitudinal axis.

The upper pulley 460 is operatively joined to the lower pulley 462 via the first cable 468, which may be configured as an X-shaped endless cable. The first cable 468 transmits rotation of the upper pulley 460 to the lower pulley 462, thus resulting in rotation of the lower pulley 462 in response to rotation of the upper pulley 460. The lower pulley 462 is joined to the transfer axle 474 at a first end of the transfer axle 474 in such a manner that rotation of the lower pulley 462 causes rotation of the transfer axle 474 around the transfer axle's central longitudinal axis.

The drive pulley 464 is attached to the transfer axle 474 at a second end of the transfer axle 474, where the second end of the transfer axle 474 is distal from its first end. Further, the drive pulley 464 is joined to the transfer axle 474 in such a manner that rotation of the transfer axle 474 causes rotation of the drive pulley 464 around the transfer axle's central longitudinal axis. In other words, rotation of the lower pulley 462 results in a corresponding rotation of the drive pulley 464.

The drive pulley 464 may be operatively joined to the slave pulley 466 by the second cable 470. This may be done in a similar manner as the one used to join the upper pulley 460 to the lower pulley 462, and thus the second cable 470 may take the form of an X-shaped endless cable. Further, like the first cable 468 for the upper and lower pulleys 460, 462, the second cable 470 may be used to cause rotation of the slave pulley 466 in response to rotation of the drive pulley 464. Thus, the right actuation assembly 456 effectively results in rotation of the drive 464 and slave pulleys 466 in response to pivotal movement of the user engagement component 436 about the user engagement component's pivot axis.

Each spinner wheel assembly 120 may include a shaft or axle that is joined to either the drive pulley 464 or the slave pulley 466. Further, this shaft may be joined to its respective drive pulley 464 or slave pulley 466 so that the shaft is constrained to rotate about the shaft's longitudinal axis as its respective pulley 464, 466 rotates. Further, each spinner wheel assembly 120 may be further configured and joined to the luggage case 100 such that as the shaft rotates, the spinner wheels 122 joined to the spinner wheel assembly 120 pivot about the spinner wheel pivot axis to move between their operational and storage positions. In this particular embodiment, the spinner wheel recesses 130 are formed in the walls 102, 104, 106, 108, 110, 112 of the luggage case 100 so that the spinner wheels 122 are stored in their respective spinner wheel recesses 130 along either the left or right walls 106, 108 of the luggage case 100, as opposed to along the front or back walls 102, 104 as in previous embodiments. However, if desired, the fourth actuation mechanism 434 for moving the spinner wheels 122 between their operational and storage positions could be designed to store the spinner wheels 122 along the front or back walls 102, 104 of the luggage case 100 as in previous embodiments. Similarly, the previous versions of the actuation mechanism 134, 234, 334 may be designed to store the spinner wheels 122 along the side walls 106, 108 rather than the front or back walls 102, 104 of the luggage case 100.

FIGS. 14A and 14B show a potential mechanism for operatively joining each spinner wheel assembly 120 to its respective drive or slave pulley 460, 466. A torsion spring 476 or the like may be joined to the pulley 464, 466, and the shaft 482 of the spinner wheel assembly 120 may be positioned within the diameter of the torsion spring 476. One end of the torsion spring 476 may be fixedly joined to the pulley 464, 466, and the other end of the torsion spring 476 may be joined to a pin 478, a fastener, or the like. The pin 478 may be fixedly joined to the spinner wheel assembly 122 and passed through a curved slot 480 defined in the pulley 464, 466. Generally, as the pulley 464, 466 rotates, the torsion spring 476 pulls on the pin 478, thus causing the spinner wheels 122 associated with the spinner wheel assembly 120 to pivot relative to the luggage case 100 as the pulley 464, 466 rotates. However, once external forces are imposed on the spinner wheel assembly 120 that prevents further pivoting of the spinner wheel 122 (e.g., the spinner wheels 122 engage the upper surface of the spinner wheel recess 130), the spinner wheels 122 stop pivoting about their spinner wheel pivot axes 176 and the shaft 482 of the spinner wheel assembly 120 stops rotating. However, the torsion spring 476 can be designed for the end joined to the pin 478 to move relative to the fixed end of the torsion spring 476 joined to the pulley 464, 466, and thus the pin 478 can move in the curved slot 480 as the pulley 464, 466 continues to be rotated. In other words, the pulley 464, 466 can continue to rotate even though further pivotal movement of the spinner wheels 122 and further rotation of the shaft 482 of the spinner wheel assembly 120 are prevented. The amount that the pulley 464, 466 can rotate relative to the shaft 482 of the spinner wheel assembly 120 is generally a function of the length of the curved slot 480. In some embodiments, the curved slot 480 may be sized so that the pulley 464, 466 can rotate at least 35 degrees, and preferably at least 38 degrees, relative to the shaft 482 of the spinner wheel assembly 120.

This limited slip connection between the shaft 482 and the pulley 464, 466 may be advantageous when two spinner wheel assemblies 120 are joined to a common actuation assembly 456, 458, and one set of spinner wheels 122 associated with one of the spinner wheel assemblies 120 must be pivoted further than another set of spinner wheels 122 associated with another of the spinner wheel assemblies 120 in order to move its spinner wheels 122 fully into the spinner wheel recess 130. Such a situation may occur, for example, when the spinner wheels 122 for one spinner wheel assembly 120 are turned inward towards the center of the luggage case 100, and the spinner wheels 122 for the other spinner wheel assembly 120 are turned outward from the luggage case 100 as shown in FIGS. 14A and 14B. In such a situation, the inner facing spinner wheels 122 only need to pivot approximately 80 degrees to be fully received within the spinner wheel recess 130 while the outer facing spinner wheels 122 need to pivot approximately 118 degrees to be fully received within the spinner wheel recess 130. In this situation, upon rotating the pulley 464, 466 (it could be the drive pulley 464 or the slave pulley 466) approximately 80 degrees, the spinner wheels 122 associated with it will stop pivoting because they will engage the upper surface defining the spinner wheel recess 130. Then, without the limited slip connection, further rotation of this pulley 464, 466 would be prevented, which would result in the other pulley 466, 464 joined to it via the second cable 470 no longer rotating. This, in turn, would leave the spinner wheels 122 associated with this other pulley 466, 464 not fully received within the spinner wheel recess 130. However, because of the limited slip connection between the shaft 482 and the pulley 464, 466, the pulley 464, 466 with the spinner wheels 122 fully received within the spinner wheel recess 130 can continue to rotate until the other pulley 466, 464 rotates far enough to cause its associated spinner wheels 122 to be fully received within the spinner wheel recess 130. Thus, the ability to allow the pulleys 464, 466 to selectively rotate relative to the shafts 482 for their associated spinner wheel assemblies 120 allows for both the drive pulley 464 and the slave pulley 466 to rotate the maximum degree of rotation required for the spinner wheels 122 of both spinner wheel assemblies 120 to be fully received within the spinner wheel recess 130 even if one or more of the spinner wheels 122 require less pivotal movement relative to the luggage case 100 than the other spinner wheels 122.

With continued reference to FIGS. 14A and 14B, each end of the second cable 470 may be joined to a spring 484 (or other bias member) or a turnbuckle. The spring 484 or turnbuckle may be utilized to tension the second cable 470 to a desired tension level, adjust the tension in the second cable 470 to a desired tension level, and/or to maintain the tension in the second cable 470 at a desired tension level.

Figure 15A:
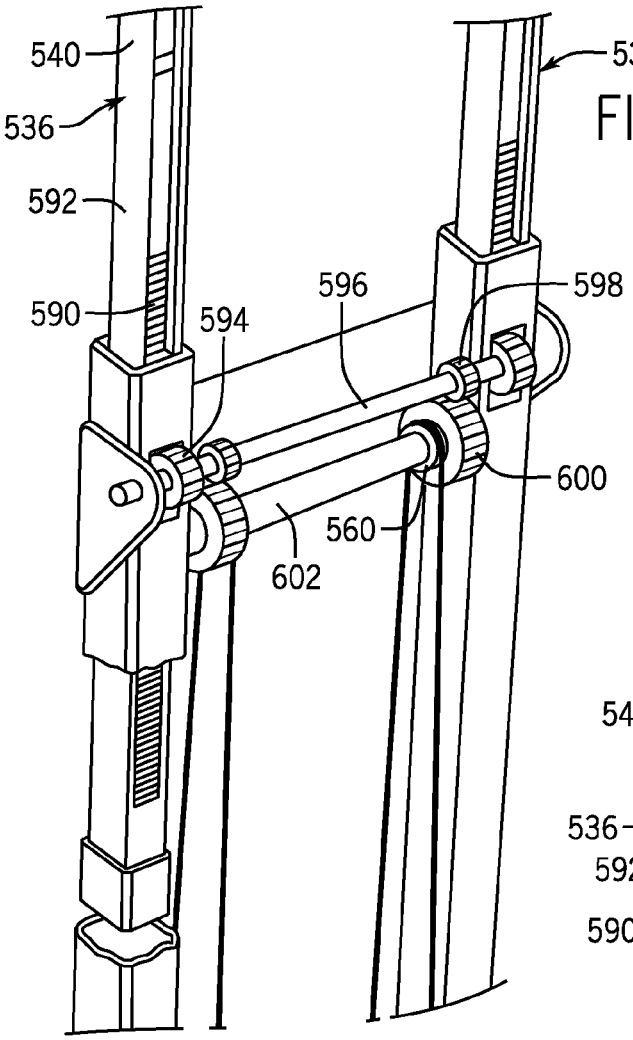
FIGS. 15A and 15B show schematic perspective illustrations of a fifth embodiment of the actuation mechanism.
Figure 15B:
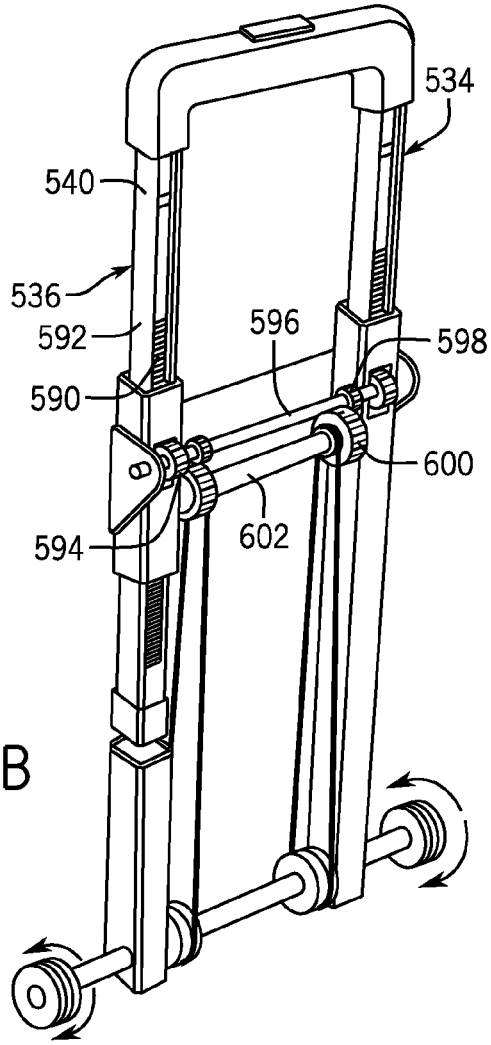

FIGS. 15A and 15B show a fifth embodiment of an actuation mechanism 534. The fifth embodiment may be generally similar to the fourth embodiment of the actuation mechanism 434 except the telescoping towing handle 540 may also function as the user engagement component 536. Specifically, the telescoping tow handle 540 may be configured to pivot the spinner wheels 122 between their operational and storage positions. In particular, a rack and pinion system or the like may be utilized to actuate pivoting of the spinner wheels 122. One or more racks 590 may be formed on the tubes 592 of the telescoping tow handle 540 and corresponding pinions 594 may be joined to a pinion axle 596 that is joined to one of the walls of the luggage case 100, such as the back wall 104. The racks 590 may be configured so that the spinner wheels 122 move from their storage position to their operational position when the tow handle 540 is initially extended from a fully retracted position. Further, the racks 590 may be configured so that once the spinner wheels 122 are deployed to their operational position, the tow handle 540 may continue to be extended to different elevations as desired by the user.

The pinion axle 596 may be joined to the back wall 104 of the luggage case 100 so that it rotates around a pinion axle rotation axis that is generally horizontal and parallel to the back wall 104. Further, each pinion 594 may be joined to the pinion axle 596 in such a manner that rotation of the pinion 594 about the pinion axle rotation axis causes rotation of the pinion axle 596. The pinion axle 596 may also include one or more first gears 598 joined to it. The first gears 598 may be joined to the pinion axle 596 in such a manner that rotation of the pinion axle 596 about the pinion axle rotation axis causes rotation of the first gears 598 about the pinion axle rotation axis. Each first gear 598 may engage a corresponding second gear 600 joined to a gear axle 602.

Like the pinion axle 596, the gear axle 602 may be joined to one of the walls of the luggage case 100, such as the back wall 104, in such a manner that the gear axle 602 rotates around a gear axle rotation axis that is generally horizontal and parallel to the back wall 104. Further, the gear axle rotation axis may generally be parallel to the pinion axle rotation axis. Each second gear 600 is joined to the gear axle 602 so that rotation of second gear 600 around the gear axle rotation axis causes rotation of the gear axle 602 around the gear axle rotation axis.

Upper pulleys 560, similar to the upper pulleys for the fourth embodiment of the actuation mechanism 434, may also be joined to the gear axle 602. Further, the upper pulleys 560 may be joined to the gear axle 602 in such a manner that rotation of the gear axle 602 about the gear axle rotation axis causes rotation of the upper pulleys 560 around the gear axle rotation axis. The upper pulleys 560 are then operatively joined to lower pulleys 462 as described above for the fourth embodiment of the actuation mechanism 434, and the remaining components of the fifth embodiment of the actuation mechanism 534 are the same as the fourth embodiment of the actuation mechanism 434 and operate in a similar manner to move the spinner wheels 122 between their operational and storage positions.

In operation, as the telescoping tow handle 540 is extended and retracted, the spinner wheels 122 are moved between their storage and operational positions. In particular, as the tow handle 540 is extended or retracted, the racks 590 on the tubes 592 of the tow handle 540 cause the pinions 594 to rotate. Rotation of the pinions 594, in turn, rotates the pinion axle 596 and the first gears 598 about the pinion axle rotation axis. This then causes rotation of the second gears 600 about the gear axle rotation axis, which in turn causes rotation of the gear axle 602 and the upper pulleys 560 about the gear axle rotation axis. As described above for the fourth embodiment of the actuation mechanism 434, rotation of the upper pulleys 560 causes rotation of the lower pulleys 460, which ultimately results in pivotal movement of the spinner wheels 122 about their spinner wheel pivot axes 126. Further, the fifth embodiment of the actuation mechanism 534 is configured so that as the tow handle 540 is extended, the spinner wheels 122 pivot from their storage position to their operational position, and as the tow handle 540 is retracted, the spinner wheels 122 pivot from their operation position to their storage position.

Figure 16A:
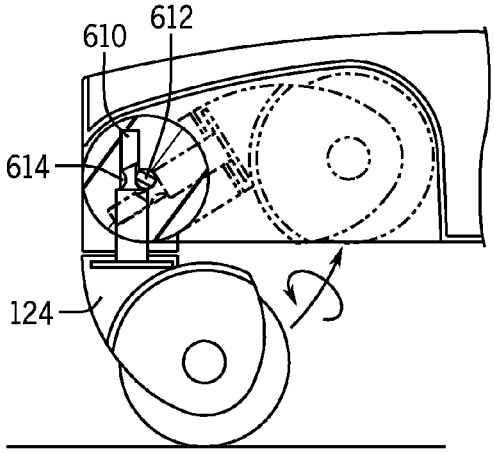
FIGS. 16A, 16B, and 16C show schematic elevation illustrations of a mechanism to align the spinner wheels of the spinner wheel assemblies in a desired orientation relative to the walls of the luggage case.
Figure 16B:
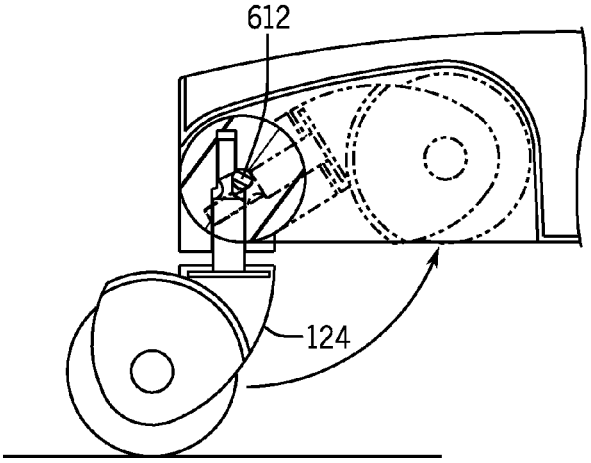
Figure 16C:
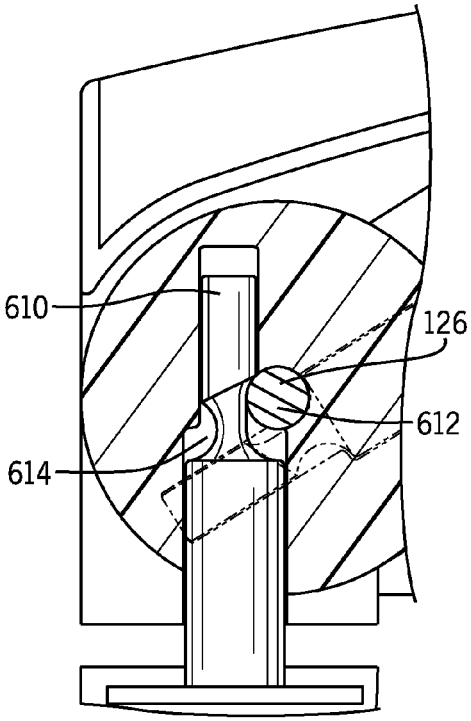

For any of the previously described embodiments of the actuation mechanism 134, 234, 334, 434, 534, it may be desirable to automatically align the direction of the deployed spinner wheels 122 of the spinner wheel assemblies 120 to a direction that will facilitate moving the spinner wheels 122 into their respective spinner wheel recess 130. Referring to FIG. 16, one potential mechanism to achieve such alignment may take the form of a gravity alignment system that is incorporated into each spinner wheel assembly 120. The gravity alignment system may include a vertical shaft 610 operatively joined to the spinner fork bracket 124 and a horizontal axle or shaft 612. The horizontal axle or shaft 612 may be the pulley shaft 196 that defines the spinner wheel pivot axis 126, and the vertical shaft 610 may define the vertical spinner axis that the spinner fork bracket 124 rotates around.

The vertical shaft 610 may be movably mounted to a spinner wheel base so that the vertical shaft 610 may move linearly in a vertical direction. The vertical shaft 610 may further include a shaft groove 614 that extends around the periphery of the vertical shaft 610. The shaft groove 614 may be positioned between the ends of the vertical shaft 610, may be located adjacent to the horizontal axle or shaft 612 so that at least a portion of the horizontal shaft 612 is received within the groove 614, and may vary in size along the circumference of the vertical shaft 610. In particular, the groove 614 may have a maximum length dimension on one radial side of the vertical shaft 610 and a minimum length on the opposite radial side and may gradually increase in length from the minimum side to maximum side along the circumference of the vertical shaft 610. Further, the minimum length dimension of the groove 614 may be approximately equal to the diameter of the horizontal axle 612, and the greatest length dimension of the groove 614 may coincide with the desired alignment of the spinner wheels 122. Thus, when the greatest length dimension for the groove 614 abuts the horizontal axle 612, the spinner wheels 122 of the spinner wheel assemblies 120 are positioned in the desired alignment.

In operation, the vertical shaft 610 moves linearly in a vertical direction relative to the horizontal axle 612. In particular, when the luggage case 100 is supported on the ground by the spinner wheel assemblies 120, the vertical shaft 610 moves upwardly relative to the horizontal axle 612 and vertically aligns the smaller length dimension of the groove 614 with the diameter of the horizontal axle 612. This allows the spinner fork bracket 124 to spin freely around the spinner vertical axis when the luggage case 100 is supported on the ground by the spinner wheel assemblies 120. To move the spinner wheels 122 into the desired alignment relative to the walls 102, 104, 106, 108, 110, 112 of the luggage case 100, the luggage case 100 is lifted upward so that the spinner wheels 122 of the spinner wheel assemblies 120 no longer contact the ground. As the luggage case 100 is lifted upward, gravity moves the vertical shaft 610 linearly downward relative to the horizontal axle 612. As the vertical shaft 610 moves downward, the portions of the groove 614 that have the smaller length dimensions can no longer accommodate the horizontal axle 612 within the groove 614. This causes the spinner fork bracket 124 to rotate about the vertical spinner axis until the radial side of the vertical shaft 610 with the greatest length dimension for the groove 614 abuts the horizontal axle 612, and thus results in the spinner wheels 122 of the spinner wheel assemblies 120 being moved into an alignment that facilitates positioning the spinner wheels 122 into their respective spinner wheel recess 130.

While these embodiments have been described in relation to a hard side suitcase, and these are the preferred embodiments of the invention, the invention may be incorporated into a soft side case in which the walls and outer housing structure of the case are made of a textile and/or more flexible material and the case includes a frame to support the wheels and other components.

The apparatuses and associated methods in accordance with the present disclosure have been described with reference to particular embodiments thereof in order to illustrate the principles of operation. The above description is thus by way of illustration and not by way of limitation. Various modifications and alterations to the described embodiments will be apparent to those skilled in the art in view of the teachings herein. Those skilled in the art may, for example, be able to devise numerous systems, arrangements and methods which, although not explicitly shown or described herein, embody the principles described and are thus within the spirit and scope of this disclosure. Accordingly, it is intended that all such alterations, variations, and modifications of the disclosed embodiments are within the scope of this disclosure as defined by the appended claims.

Where appropriate, common reference words are used for common structural and method features. However, unique reference words are sometimes used for similar or the same structural or method elements for descriptive purposes. As such, the use of common or different reference words for similar or the same structural or method elements is not intended to imply a similarity or difference beyond that described herein.

In methodologies directly or indirectly set forth herein, various steps and operations are described in one possible order of operation, but those skilled in the art will recognize that the steps and operations may be rearranged, replaced, or eliminated without necessarily departing from the spirit and scope of the disclosed embodiments.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use of the invention unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

The principle and mode of operation of this invention have been explained and illustrated in its preferred embodiments. However, it must be understood that this invention may be practiced otherwise than as specifically explained and illustrated without departing from its spirit or scope.

What is claimed is:

1. A luggage case comprising:

opposing front and back walls forming major faces of the luggage case;

opposing side walls forming side faces of the luggage case and extending between the opposing front and back walls;

opposing top and bottom end walls forming top and bottom ends of the luggage case wherein the front, back, side, top end, and bottom end walls together define an outer structure and enclosed space of the luggage case;

at least one recess defined by at least one of the walls proximate the bottom end of the luggage case;

at least one pair of spinner wheel assemblies joined to at least one of the walls proximate the bottom end of the luggage case, each spinner wheel assembly including at least one wheel that rotates about at least two orthogonal axes, and each spinner wheel assembly pivots about a pivot axis from a first position where the at least one wheel projects beyond the bottom end wall to engage a support surface to allow the luggage case to be wheeled on the support surface to a second position where the least one wheel is positioned within one of the at least one recess and does not project beyond the bottom end wall; and an actuation mechanism including a user engagement component and at least one actuation assembly, the user engagement component movably joined to one of the walls of the luggage case at a location remote from the spinner wheel assemblies, the at least one actuation assembly operatively associated with the user engagement component and operatively associated with at least one of the spinner wheel assemblies, the at least one actuation assembly comprising:

at least one pulley; and at least one cable wrapped around the at least one pulley and operably connected to the user engagement component and the at least one wheel;

wherein:

selective movement of the user engagement component actuates the at least one cable to pivot the at least one wheel of each spinner wheel assembly operatively associated with the at least one actuation assembly between the first and second positions; and each spinner wheel assembly of each pair of spinner wheel assemblies pivots toward the other when pivoted about its respective pivot axis to its respective second position.

2. A luggage case as claimed in claim 1 wherein the first position is an operational position of the at least one wheel and the second position is a storage position of the at least one wheel, and the user engagement component rotates between a first position that corresponds to the storage position of the at least one wheel and a second position that corresponds to the operational position of the at least one wheel.

3. A luggage case as claimed in claim 2 wherein the actuation mechanism is configured to allow the user engagement component to rotate from the first position of the user engagement member to the second position of the user engagement component even if the at least one wheel of any of the spinner wheel assemblies does not pivot from the storage position to the operational position.

4. A luggage case as claimed in claim 3 wherein the at least one cable comprises a connector with a slot, the luggage case includes a telescoping tow handle housing proximate the user engagement component, the telescoping tow handle housing includes a curved slot, and an elongated member is joined to the user engagement component and extends through the slot and the curved slot.

5. A luggage case as claimed in claim 2, wherein the actuation mechanism is configured to allow the user engagement component to rotate from the second position of the user engagement member to the first position of the user engagement component even if the at least one wheel of any of the spinner wheel assemblies is prevented from moving from the operational position to the storage position by an obstruction.

6. A luggage case as claimed in claim 5, wherein each of the at least one actuation assembly includes a spring operatively associated with the user engagement component and operatively associated with the at least one wheel of at least one of the spinner wheel assemblies, and the spring elongates when the at least one wheel operatively associated with the spring is prevented from moving from the operational position to the storage position.

7. A luggage case as claimed in claim 2 wherein the at least one actuation assembly comprises a spinner wheel spring operatively associated with the at least one wheel of one of the spinner wheel assemblies, and the spinner wheel spring biases the at least one wheel associated with the spinner wheel spring to either the operational position or the storage position.

8. A luggage case as claimed in claim 2, further comprising a lock assembly operatively associated with the at least one wheel of one of the spinner wheel assemblies and configured to lock the at least one wheel associated with the lock assembly in the operational position.

9. A luggage case as claimed in claim 8 wherein at least one pulley comprises a cam surface and a disc with a slot that are operatively associated with the at least one wheel associated with the lock assembly and that are operatively associated with the lock assembly, and the disc is joined to the at least one pulley in such a manner that the at least one pulley rotates relative to the disc within a predefined rotational range and also rotates in conjunction with the disc for another predefined rotational range.

10. A luggage case as claimed in claim 9 wherein the lock assembly includes a lock housing, a bias member, and an engagement member biased by the bias member to project from the lock housing and configured to slide relative to the lock housing, at least an end portion of the engagement member is received within the slot of the disc when the at least one wheel associated with the lock assembly is positioned in the operational position, and rotation of the at least one pulley relative to the disc removes the engagement member from slot in the disc via engagement of the engagement member with the cam surface of the at least one pulley.

11. A luggage case as claimed in claim 1 wherein the user engagement component comprises a dial or a lever, and the user engagement component is movably joined to the back wall of the luggage case.

12. A luggage case as claimed in claim 1 wherein the user engagement component includes a detent configured to resist movement of the user engagement position at positions of the user engagement component corresponding to the first and second positions of the at least one wheel of the spinner wheel assemblies.

13. A luggage case as claimed in claim 1 wherein the user engagement component comprises a telescoping tow handle including at least one rack that engages at least one gear operatively associated with the at least one actuation assembly, extension of the tow handle pivots the at least one wheel to the first position, and retraction of the tow handle pivots the at least one wheel to the second position.

14. A luggage case as claimed in claim 1 wherein at least one spinner wheel assembly is configured to rotate its at least one wheel to a desired orientation relative to the walls of the luggage case.

15. A luggage case as claimed in claim 1 wherein each of the at least one recess includes at least one open side.

16. A luggage case as claimed in claim 1 wherein each of the least one recess includes an elongated rib projecting from an upper surface defining the recess, and the elongated rib is received between a gap of the at least one wheel of at least one of the spinner wheel assemblies when the at least one wheel is positioned in the second position.

17. A luggage case as claimed in claim 1 wherein the at least one pair of spinner wheel assemblies comprises four spinner wheel assemblies with each spinner wheel assembly positioned proximate a corner of the luggage case.

18. A luggage case as claimed in claim 17 wherein the at least one actuation assembly comprises two actuation assemblies with each actuation assembly joined to two of the four spinner wheel assemblies.

19. A luggage case as claimed in claim 1, further comprising an opening line formed in said side faces and end walls along which separates said luggage case into a lid and base to allow access to the enclosed space within the luggage case.

20. A luggage case as claimed in claim 1, further comprising a hardside luggage case wherein the front, back, side, and end walls are rigid and self-supporting.

21. A luggage case as claimed in claim 1, wherein the at least one pulley further comprises a first pulley and a second pulley, wherein the at least one cable wraps around both the first pulley and the second pulley.

22. A luggage case as claimed in claim 1, wherein the at least one pulley comprises a first pulley and a second pulley; and the at least one cable comprises a first cable and a second cable; wherein the first cable is wrapped around the first pulley and the second cable is wrapped around the second pulley.

* * * * *